US008548351B2

(12) United States Patent
Sato et al.

(10) Patent No.: US 8,548,351 B2
(45) Date of Patent: Oct. 1, 2013

(54) IMAGE-FORMING DEVICE

(71) Applicants: Shougo Sato, Seto (JP); Susumu Sakuma, Kasugai (JP)

(72) Inventors: Shougo Sato, Seto (JP); Susumu Sakuma, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/671,298

(22) Filed: Nov. 7, 2012

(65) Prior Publication Data

US 2013/0064590 A1 Mar. 14, 2013

Related U.S. Application Data

(63) Continuation of application No. 12/702,675, filed on Feb. 9, 2010, now Pat. No. 8,311,443.

(30) Foreign Application Priority Data

Feb. 16, 2009 (JP) ..... 2009-033271
Feb. 16, 2009 (JP) ..... 2009-033272

(51) Int. Cl.
*G03G 15/16* (2006.01)

(52) U.S. Cl.
USPC ..... 399/101; 399/120; 399/123; 399/343; 399/358; 399/359

(58) Field of Classification Search
USPC ..... 399/101, 120, 123, 343, 358, 359
See application file for complete search history.

(56) References Cited

U.S. PATENT DOCUMENTS

| | | | | |
|---|---|---|---|---|
| 6,173,139 | B1 | 1/2001 | Takahata et al. | |
| 6,708,011 | B2 | 3/2004 | Nomura et al. | |
| 2003/0053819 | A1 | 3/2003 | Nomura et al. | |
| 2006/0216086 | A1 * | 9/2006 | Yuasa et al. | 399/358 |
| 2007/0048022 | A1 | 3/2007 | Inaba | |
| 2009/0196652 | A1 | 8/2009 | Sakuma | |

FOREIGN PATENT DOCUMENTS

| | | | |
|---|---|---|---|
| JP | 04-215668 | A | 8/1992 |
| JP | 05-257340 | A | 10/1993 |
| JP | 06-175429 | A | 6/1994 |
| JP | 08-123127 | A | 5/1996 |
| JP | 10-240041 | A | 9/1998 |
| JP | 2002-014542 | A | 1/2002 |
| JP | 2002-311670 | A | 10/2002 |
| JP | 2003-015378 | A | 1/2003 |

(Continued)

OTHER PUBLICATIONS

English Translation JP 2002311670 to Maehashi et al. Oct. 2002.*

(Continued)

*Primary Examiner* — Ryan Walsh
(74) *Attorney, Agent, or Firm* — Banner & Witcoff, Ltd.

(57) ABSTRACT

An image-forming device includes a plurality of developing units, an endless belt, and a cleaning unit. The cleaning unit includes a cleaning member and a conveying unit. The cleaning member contacts the endless belt to clean toner remaining on the endless belt. The conveying unit includes a first conveying unit, a second conveying unit, and a first relaying member. The first relaying member relays the remaining toner conveyed by the first conveying unit to the second conveying unit, and has a relay-axis. The cleaning member pivots about the relay axis to move between a contacting position for contacting the endless belt and a separating position for separating from the endless belt.

1 Claim, 16 Drawing Sheets

1

(56) References Cited

FOREIGN PATENT DOCUMENTS

| | | | |
|---|---|---|---|
| JP | 2004-012674 | A | 1/2004 |
| JP | 2005-043558 | A | 2/2005 |
| JP | 2005-156780 | A | 6/2005 |
| JP | 2005-266219 | A | 9/2005 |
| JP | 2005-266530 | A | 9/2005 |
| JP | 2007-079445 | A | 3/2007 |
| JP | 2007-218936 | A | 8/2007 |
| JP | 2008-040129 | A | 2/2008 |

OTHER PUBLICATIONS

JP Office Action dtd Dec. 21, 2010, JP Appnl. 2009-033271, English translation.

JP Office Action dtd Mar. 8, 2011, JP Appln. 2009-033272, English Translation.

* cited by examiner

IMAGE-FORMING DEVICE

CROSS REFERENCE TO RELATED APPLICATION

This application is a continuation of prior U.S. application Ser. No. 12/702,675, filed Feb. 9, 2010, which claims priority from Japanese Patent Applications No. 2009-033271 and No. 2009-033272 each filed Feb. 16, 2009. The entire contents of each of the prior applications are incorporated herein by reference.

TECHNICAL FIELD

The present invention relates to an image-forming device such as an electrophotographic color printer.

BACKGROUND

One electrophotographic color printer well known in the art is a tandem color laser printer equipped with four developer cartridges accommodating toner in the respective colors yellow, magenta, cyan, and black; and four photosensitive drums corresponding to these developer cartridges. The printer can switch between a monochrome mode for forming images in black by keeping the developer cartridge for black in contact with the photosensitive drums while separating the non-black developer cartridges from their photosensitive drums, and a color mode for forming color images by placing all developer cartridges in contact with their respective photosensitive drums.

One such tandem color laser printer includes four photosensitive drums, a belt unit having an endless belt disposed so as to confront the four photosensitive drums, and a cleaning unit for cleaning residual toner deposited on the endless belt. The cleaning unit includes a blade and roller for recovering toner from the endless belt, and a cleaning box for storing the recovered toner.

SUMMARY

In the conventional image-forming device described above, the cleaning unit is positioned on the opposite side of the belt unit from the photosensitive drums. Hence, in order to perform maintenance on the cleaning unit, an operator must first remove all of the photosensitive drums and further remove the belt unit to access the cleaning unit. The difficulty in accessing the cleaning unit for maintenance is a problematic point in the structure of this image-forming device.

This problem can be resolved by providing the cleaning unit on the same side of the belt unit as the photosensitive drums. However, in the case of a direct tandem type image-forming device that conveys sheets of paper between the belt unit and the photosensitive drums, for example, disposing the cleaning unit on the same side of the belt unit as the photosensitive drums would require that the cleaning unit be separated from the belt unit during image-forming operations and placed in contact with the belt unit for cleaning the endless belt.

Such a construction would also require a complex contacting/separating mechanism capable of placing the cleaning unit in contact with the belt unit and separating the cleaning unit therefrom, and would lead to increased complexity of the mechanical structure around the cleaning unit.

Further, when the cleaning unit is disposed on the same side of the belt unit as the photosensitive drums, the cleaning box for storing toner recovered by the blade can be provided integrally with a developer cartridge. With this construction, the cleaning box can be replaced simultaneously with the developer cartridge.

However, when the cleaning box is integrally provided with a developer cartridge, the cleaning box must be moved together with the developer cartridge when the cartridge is placed in contact with its photosensitive drum or separated therefrom, leading to increased complexity of the mechanical structure around the cleaning unit.

In view of the foregoing, it is an object of the present invention to provide a tandem image-forming device having a simple construction and capable of facilitating maintenance of the cleaning unit.

In order to attain the above and other objects, the invention provides an image-forming device including a holding member, a plurality of developing units, an endless belt, and a cleaning unit. The holding member holds a plurality of photosensitive members arranged in a first direction. Each photosensitive member is apart from an adjacent photosensitive member and extends in a second direction. The plurality of developing units corresponds to the plurality of photosensitive members respectively and each developing unit supplies developer to the corresponding photosensitive member. The endless belt has a first straight section. The first straight section extends in the first direction, and the first straight section opposes the plurality of photosensitive members in a third direction. The cleaning unit opposes the first straight section to clean toner remaining on the endless belt. The cleaning unit includes a cleaning member, an accommodating unit and a conveying unit. The cleaning member contacts the endless belt to clean the remaining toner. The accommodating unit accommodates the remaining toner cleaned by the cleaning member. The conveying unit is held by the holding member and conveys the remaining toner from the cleaning member to the accommodating unit. The conveying unit includes a first conveying unit, a second conveying unit and a first relaying member. The first conveying unit has a first end and a second end in the second direction and conveys the remaining toner cleaned by the cleaning member from the first end to the second end. The second conveying unit is disposed at the second end to convey the remaining toner conveyed by the first conveying unit in the third direction. The first relaying member is disposed at the second end to relay the remaining toner conveyed by the first conveying unit to the second conveying unit and has a relay-axis extending in the second direction. The cleaning member pivots about the relay axis to move between a contacting position for contacting the endless belt and a separating position for separating from the endless belt.

Another aspect of the present invention provides an image-forming device including an endless belt, a plurality of photosensitive members, a holding member, a plurality of developing units, a cleaning unit and a separating unit. The endless belt circularly moves in a rotational direction and has a first straight section. The first straight section extends in a first direction. The plurality of photosensitive members is arranged in the first direction. Each photosensitive member is apart from an adjacent photosensitive member, extends in a second direction and opposes the first straight section in a third direction. The plurality of photosensitive members includes a first photosensitive member and a plurality of second photosensitive members other than the first photosensitive member. The second photosensitive members are disposed downstream of the first photosensitive member in the rotational direction on the first straight section. The holding member holds the plurality of photosensitive members. The plurality of developing units includes a first developing unit and a plurality of second developing units. The first developing unit is mounted on the first photosensitive member. The second developing units are mounted on the plurality of second photosensitive members respectively. The cleaning unit opposes the first straight section to clean toner remaining on the endless belt. The cleaning unit includes a cleaning member, an accommodating unit and a conveying unit. The cleaning member is held by the holding member and is disposed upstream of the first photosensitive member, the cleaning member contacting the endless belt to clean toner remaining on the endless belt. The accommodating unit is mounted on the first developing unit to accommodate the remaining toner cleaned by the cleaning member. The conveying unit is held by the holding member and conveys the remaining toner from the cleaning member to the accommodating unit. The separating unit separates the plurality of second developing units from the plurality of second photosensitive members without separating the first developing unit from the first photosensitive member.

BRIEF DESCRIPTION OF THE DRAWINGS

The particular features and advantages of the invention as well as other objects will become apparent from the following description taken in connection with the accompanying drawings, in which:

FIG. 2(*b*) is a perspective view of a shutter;

DETAILED DESCRIPTION

1. Overall Structure of a Color Laser Printer

Figure 1:
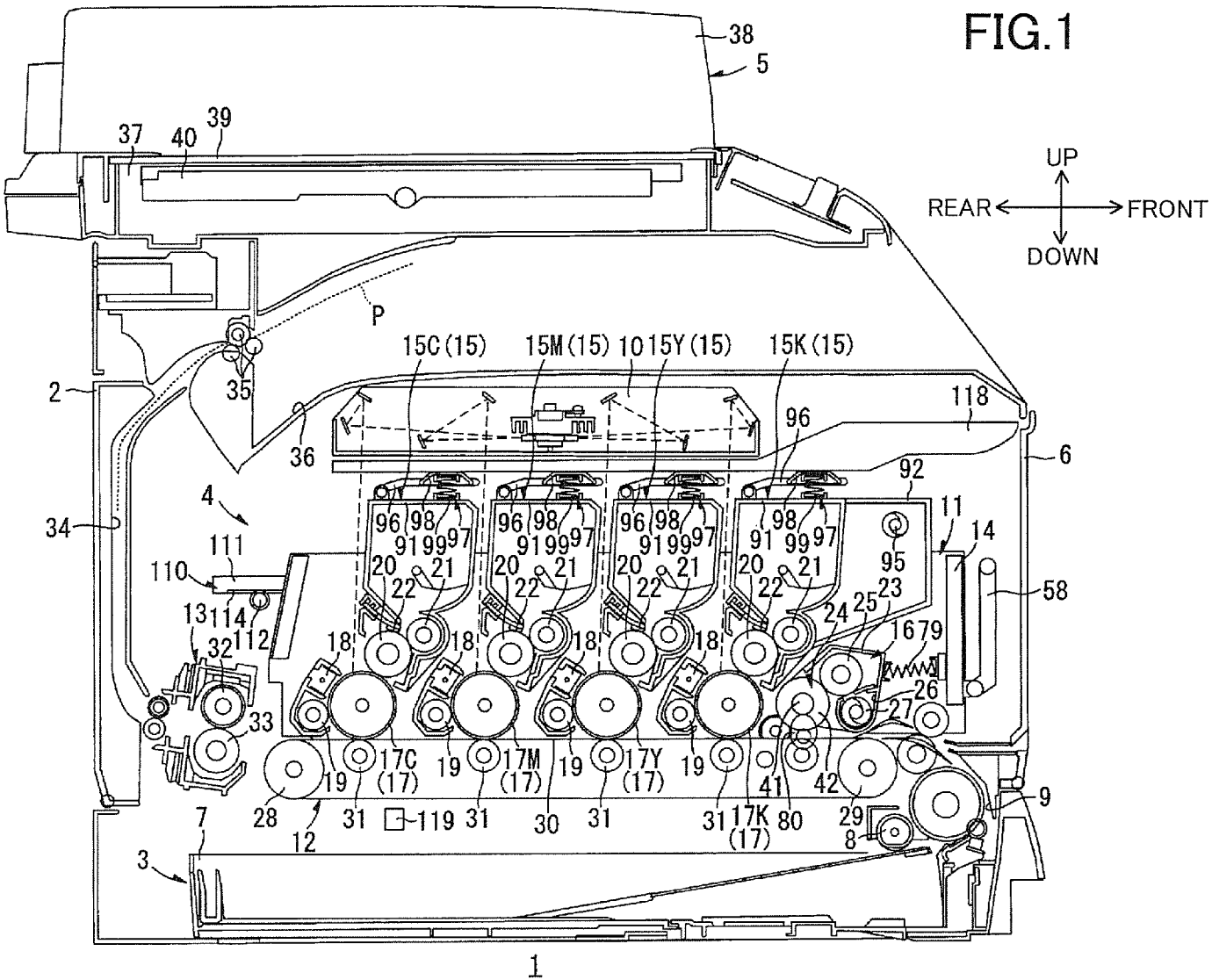
FIG. 1 is a side cross-sectional view of a color laser printer serving as a preferred embodiment of an image-forming device according to the present invention.

FIG. 1 is a side cross-sectional view of a color laser printer 1 serving as a preferred embodiment of the image-forming device according to the present invention. As shown in FIG. 1, the printer 1 is a horizontal direct tandem type color laser printer. The printer 1 includes a main casing 2 and, within the main casing 2, a feeding unit 3 for feeding sheets of paper P to be printed, an image-forming unit 4 for forming images on the sheets of paper P conveyed from the feeding unit 3, and an image-reading unit 5 for reading image data from original documents. Thus, the printer 1 is a multifunction peripheral that is integrally provided with the image-forming unit 4 and image-reading unit 5.

(1) Main Casing

The main casing 2 has a box shape that is substantially rectangular in a side view. The feeding unit 3, image-forming unit 4, and image-reading unit 5 are accommodated in the main casing 2. A front cover 6 is provided on one side wall of the main casing 2 for exposing the inside of the main casing 2 in order to mount or remove a process unit 11 described later.

In the following description, the side of the printer 1 on which the front cover 6 is provided (right side in FIG. 1) will be referred to as the front side, and the opposite side (left side in FIG. 1) as the rear side. The left and right sides of the printer 1 will be based on the perspective of a user viewing the printer 1 from the front. Hence, the near side of the printer 1 in FIG. 1 is the left side, and the far side is the right side.

(2) Feeding Unit

The feeding unit 3 includes a paper tray 7 for accommodating sheets of paper P. The paper tray 7 is detachably mounted in the bottom section of the main casing 2. A feeding roller 8 and a U-shaped feeding path 9 are disposed above the front end of the paper tray 7.

The feeding roller 8 rotates to feed sheets of paper P accommodated in the paper tray 7 onto the feeding path 9 one sheet at a time. The sheets of paper P are subsequently conveyed from the feeding path 9 to the image-forming unit 4 so as to pass between four photosensitive drums 17 and a conveying belt 30 described later.

(3) Image-Forming Unit

The image-forming unit 4 includes a scanning unit 10, a process unit 11, a transfer unit 12, and a fixing unit 13.

(3-1) Scanning Unit

The scanning unit 10 is disposed in the top section of the main casing 2. As indicated by dotted lines in FIG. 1, the scanning unit 10 irradiates laser beams toward the four photosensitive drums 17 described later based on image data in order to expose the photosensitive drums 17.

(3-2) Process Unit (3-2-1) Structure of the Process Unit

The process unit 11 is disposed below the scanning unit 10 and above the transfer unit 12. The process unit 11 includes a single process frame 14, and four developer cartridges 15 provided respectively for each of the four colors.

The process frame 14 can be slid into or out of the main casing 2 in the front-to-rear direction and, thus, can be detachably mounted in the main casing 2. The process frame 14 retains photosensitive drums 17, Scorotron chargers 18, and drum-cleaning rollers 19. Four of the photosensitive drums 17 are arranged parallel to one another and oriented with their axes along the left-to-right direction, and are juxtaposed in the left-to-right direction. Specifically, the photosensitive drums 17 include a black photosensitive drum 17K, a yellow photosensitive drum 17Y, a magenta photosensitive drum 17M, and a cyan photosensitive drum 17C arranged in this order from front to back.

The Scorotron chargers 18 are disposed diagonally above and rearward of the respective photosensitive drums 17 and confront but do not contact the photosensitive drums 17. The drum-cleaning rollers 19 are disposed to the rear of the respective photosensitive drums 17 and confront and contact the photosensitive drums 17. The developer cartridges 15 are detachably mounted in the process frame 14 in a juxtaposed state above the corresponding photosensitive drums 17 and confront the corresponding photosensitive drums 17. Specifically, the developer cartridges 15 include a black developer cartridge 15K, a yellow developer cartridge 15Y, a magenta developer cartridge 15M, and a cyan developer cartridge 15C arranged in this order from front to rear. Each of the developer cartridges 15 is also provided with a developing roller 20.

Each developing roller 20 is rotatably supported in the lower end of the corresponding developer cartridge 15. The bottom rear edge of the developing roller 20 is exposed through the lower edge of the developer cartridge 15 and contacts the corresponding photosensitive drum 17 from the top thereof. Each developer cartridge 15 also includes a supply roller 21 for supplying toner to the corresponding developing roller 20, and a thickness-regulating blade 22 for regulating the thickness of the toner supplied to the developing roller 20. The developer cartridge 15 accommodates toner for a corresponding color in the space formed above the supply roller 21.

(3-2-2) Developing Operations of the Process Unit

Toner accommodated in each developer cartridge 15 is supplied onto the corresponding supply roller 21, which in turn supplies the toner to the developing roller 20. At this time, the toner is positively tribocharged between the supply roller 21 and developing roller 20.

As the developing roller 20 rotates, the thickness-regulating blade 22 regulates the toner carried on the surface of the developing roller 20 to a prescribed thickness, so that the developing roller 20 carries a uniform thin layer of toner thereon. In the meantime, the Scorotron charger 18 applies a uniform charge of positive polarity to the surface of the corresponding photosensitive drum 17 while the photosensitive drum 17 rotates. Subsequently, the scanning unit 10 irradiates a laser beam (indicated by a dotted line in FIG. 1) in a high-speed scan in order to form an electrostatic latent image on the surface of the respective photosensitive drum 17 based on image data for a respective color corresponding to an image to be formed on a sheet of paper P.

As the photosensitive drum 17 continues to rotate, the positively charged toner carried on the surface of the developing roller 20 is supplied to the electrostatic latent image formed on the surface of the photosensitive drum 17, thereby developing the electrostatic latent image into a visible toner image through reverse development.

(3-3) Transfer Unit

The transfer unit 12 is disposed in the main casing 2 above the feeding unit 3 and below the process unit 11 and extends in the front-to-rear direction. The transfer unit 12 includes a drive roller 28, a follow roller 29, a conveying belt 30, and four transfer rollers 31.

The drive roller 28 and follow roller 29 are disposed parallel to each other and are separated in the front-to-rear direction. The conveying belt 30 is mounted around the drive roller 28 and follow roller 29, with the top portion of the conveying belt 30 opposing and contacting each of the photosensitive drums 17 from below. When the drive roller 28 is driven to rotate, the conveying belt 30 circulates in a counterclockwise when viewed from the left side so that the top portion of the conveying belt 30 in contact with the photosensitive drums 17 moves rearward for conveying a sheet of paper P rearward.

The transfer rollers 31 are disposed inside the conveying belt 30 at positions opposing corresponding photosensitive drums 17, with the top portion of the conveying belt 30 interposed therebetween. The positions between the transfer rollers 31 and respective photosensitive drums 17 will be referred to as transfer positions. When a sheet of paper P is supplied from the feeding unit 3, the conveying belt 30 conveys the sheet rearward so that the sheet passes sequentially through each transfer position between the photosensitive drums 17 and corresponding transfer rollers 31. As the sheet is conveyed on the conveying belt 30, toner images in each color carried on the respective photosensitive drums 17 are sequentially transferred onto the sheet to form a color image.

In some cases, residual toner remains on the peripheral surfaces of the photosensitive drums 17 after the toner images have been transferred onto the paper P. Therefore, when the residual waste toner is brought opposite the drum-cleaning roller 19 by the rotation of the photosensitive drum 17, the waste toner is transferred onto the peripheral surface of the drum-cleaning roller 19 owing to a cleaning bias applied to the drum-cleaning roller 19 and is temporarily retained on the drum-cleaning roller 19.

(3-4) Fixing Unit

The fixing unit 13 is disposed to the rear of the transfer unit 12 and includes a heating roller 32, and a pressure roller 33 in confrontation with the heating roller 32. After a color image has been transferred onto the sheet of paper P in the transfer unit 12, the image is fixed to the sheet by a combination of heat and pressure as the sheet passes between the heating roller 32 and pressure roller 33 in the fixing unit 13.

(4) Discharge Section

After the toner image has been fixed to the paper P, the sheet is conveyed along a U-shaped discharge path 34 toward a pair of discharge rollers 35 disposed at the downstream end of the path. The discharge rollers 35 discharge the sheet onto a discharge tray 36 formed on the top of the scanning unit 10.

(5) Image-Forming Unit

The image-reading unit 5 is disposed above the discharge tray 36 and includes a document bed 37, and a restraining cover 38 pivotably supported on the document bed 37.

The document bed 37 is formed in a plate shape that is rectangular in a plan view. A glass plate 39 is provided in the top surface of the document bed 37 for supporting an original document. The document bed 37 also has a built-in CCD sensor 40 disposed below the glass plate 39 for reading image data from an original placed on the glass plate 39. During an image-reading operation, the CCD sensor 40 slides along the left-to-right direction while opposing the bottom surface of the glass plate 39.

The restraining cover 38 has a rectangular shape in a plan view and functions to cover the top of the document bed 37. The restraining cover 38 can be pivoted between a closed position in which the restraining cover 38 is horizontal and covers the top of the glass plate 39, and an open position in which the restraining cover 38 is erect and exposes the top surface of the glass plate 39. After the user places an original document on the glass plate 39 of the image-reading unit 5 and closes the restraining cover 38, the CCD sensor 40 slides along the bottom surface of the glass plate 39 and reads image data from the original document.

Thereafter, the printer 1 can form an image on the paper P in the image-forming unit 4, as described above, based on the image data for the original read by the image-reading unit 5. The printer 1 also possesses functions for transmitting this image data to a personal computer (not shown) connected to the printer 1 or for transmitting the image data to a device via a public telephone network.

2. Detailed Description of the Process Unit

Figure 2A:
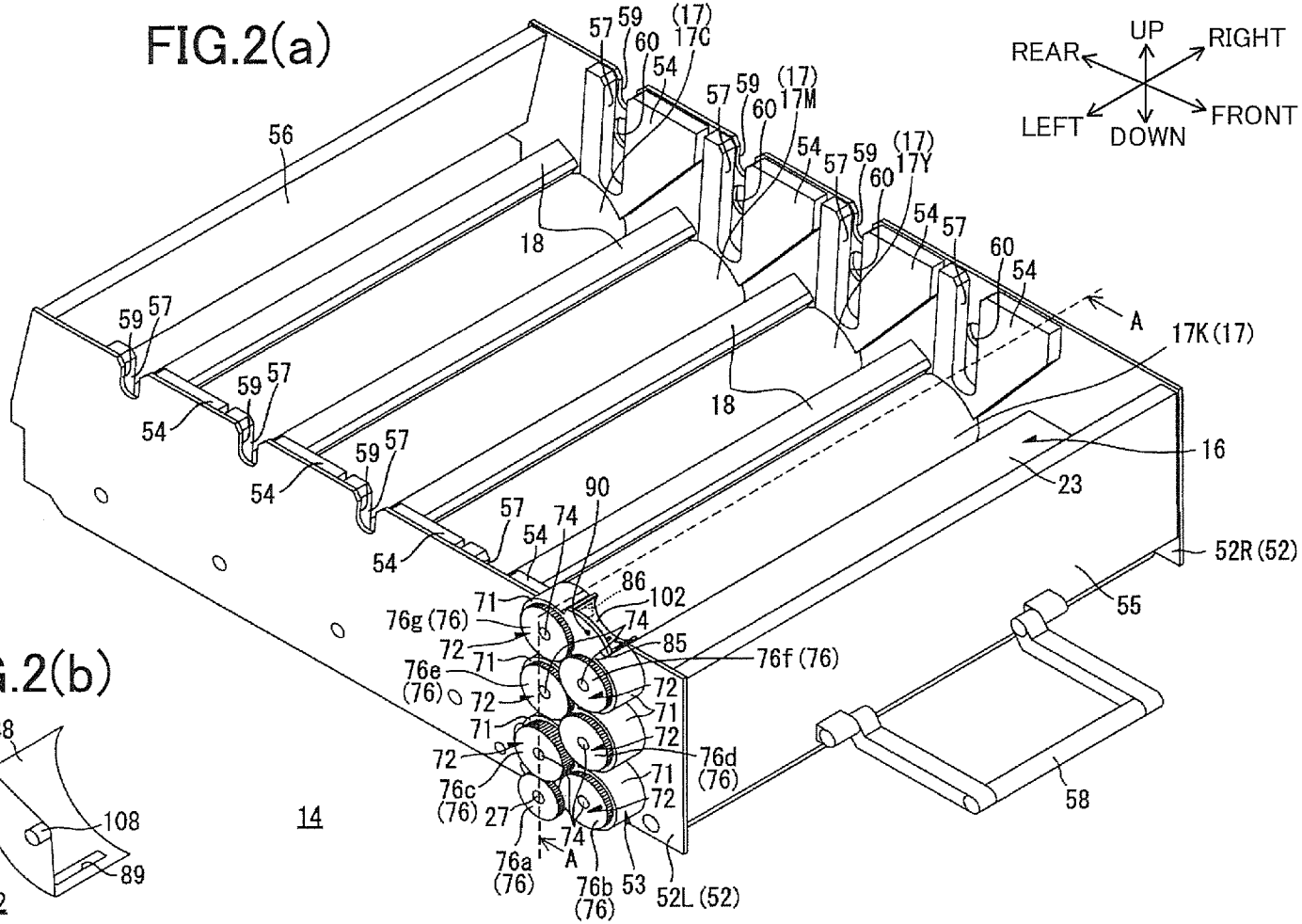
FIG. 2(*a*) is a perspective view of a process frame.
Figure 2B:
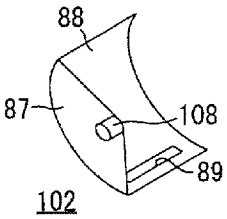
Figure 3:
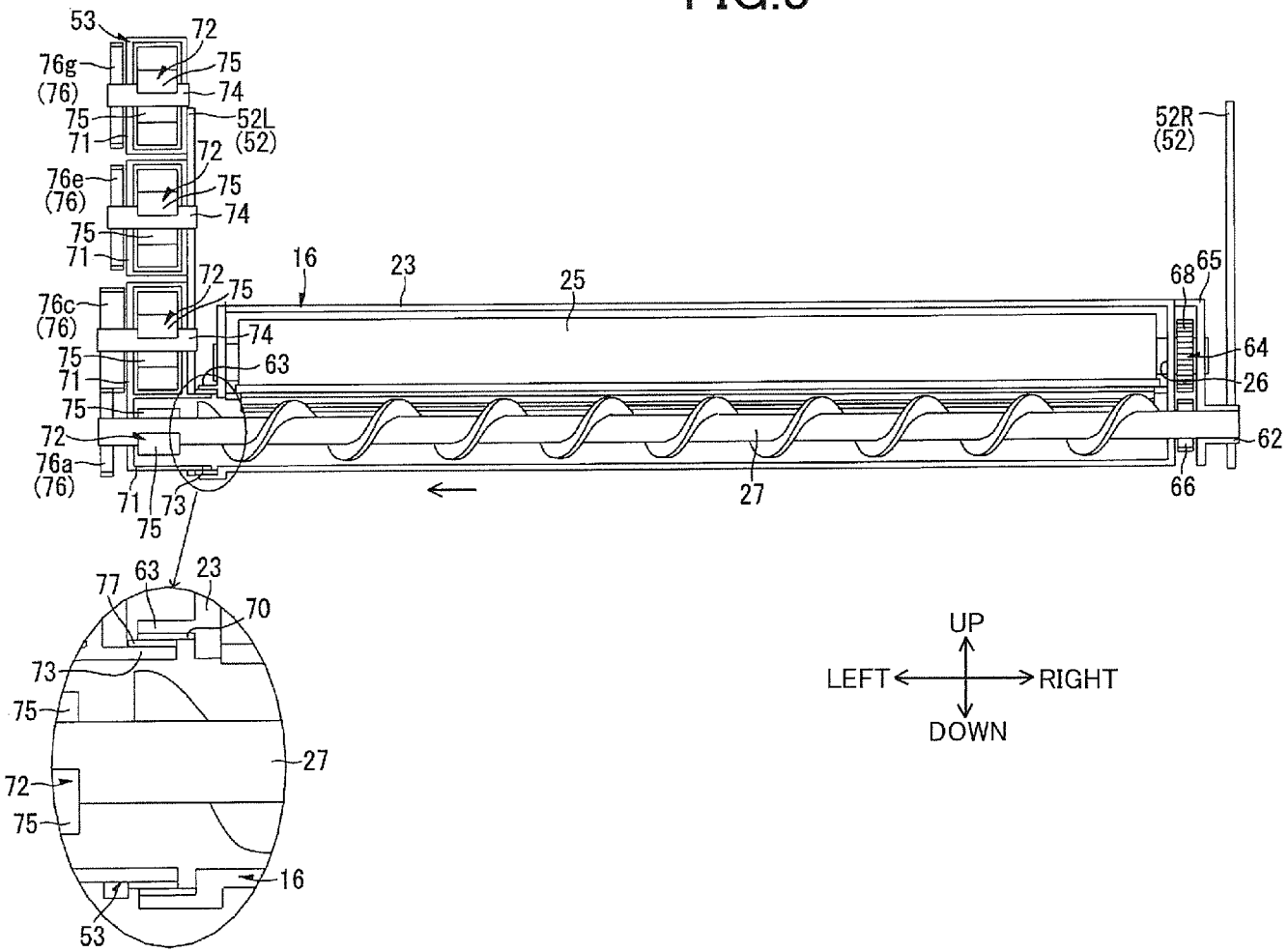
FIG. 3 is a cross-sectional view of the process frame taken along the line A-A indicated in FIG. 2(*a*)
Figure 8:
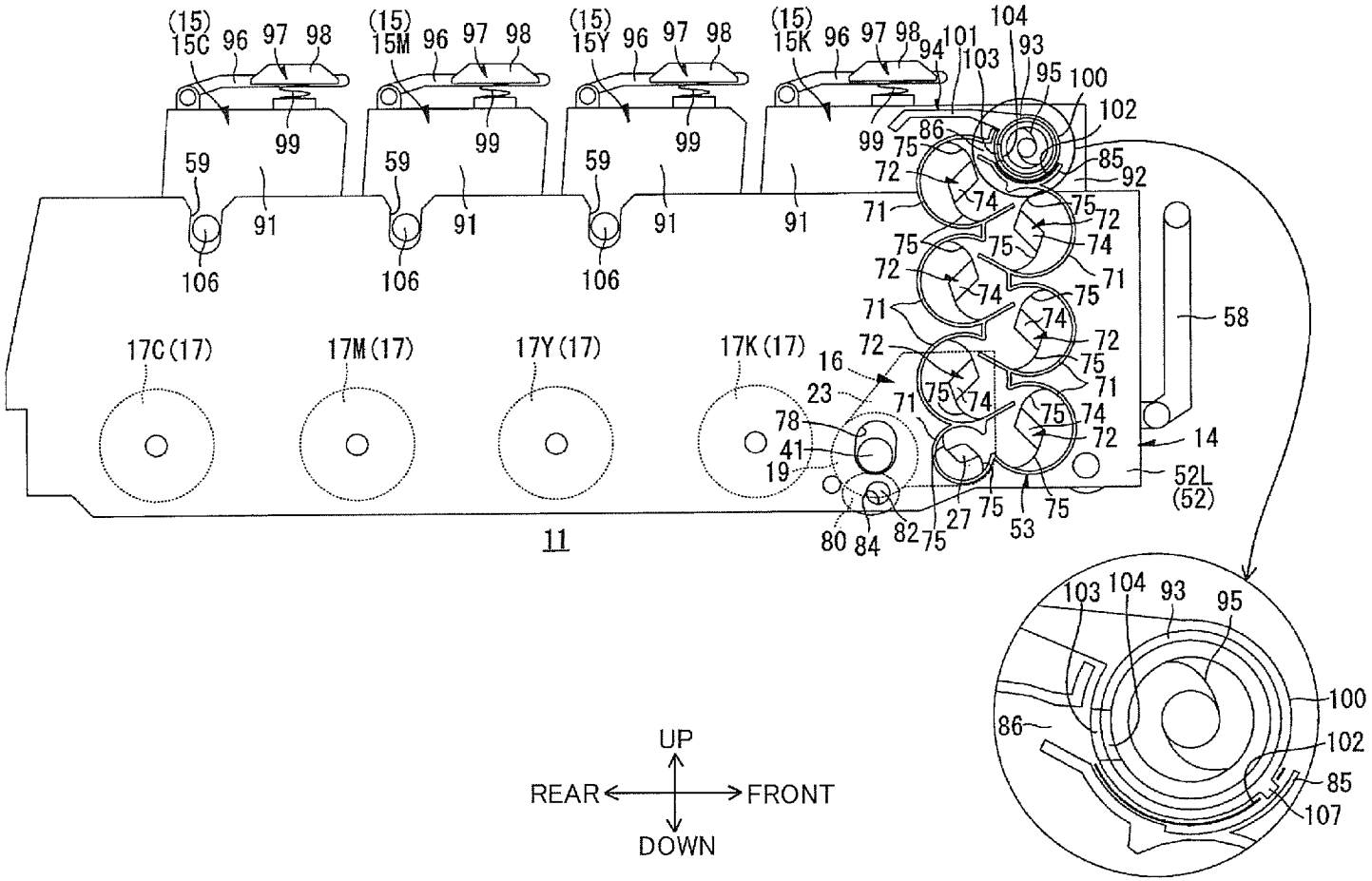
FIG. 8 is a side view illustrating operations of a stopcock when a shutter part in an open position.

FIG. 2(*a*) is a perspective view of the process frame 14 in FIG. 1, and FIG. 2(*b*) is a perspective view of a shutter indicated in FIG. 2(*b*). FIG. 3 is a cross-sectional view of the process frame 14 taken along the line A-A indicated in FIG. 2(*a*). FIG. 8 is a side view illustrating operations of a stopcock 94 shown in FIG. 4 when a shutter part 100 is laid downward in a horizontal orientation (i.e., in an open position).

(1) Process Frame

As shown in FIG. 2(*a*), the process frame 14 includes a front beam 55, a rear beam 56, and a pair of side plates 52 positioned parallel to one another and on opposite sides of the front beam 55 and rear beam 56 so as to be separated from each other in the left-to-right direction.

The front beam 55 is formed in a plate shape that is substantially rectangular in a front side view. The plate-shaped front beam 55 is elongated in the left-to-right direction and spans between the front edges of the side plates 52. A frame handle 58 is provided on the front surface of the front beam 55. The frame handle 58 can pivot between a horizontal position and an erect position. The user grips the frame handle 58 when mounting the process frame 14 in or removing the process frame 14 from the main casing 2. The rear beam 56 is also formed in a plate shape that is substantially rectangular in a front side view. The rear beam 56 is elongated in the left-to-right direction and spans between the rear edges of the side plates 52.

The side plates 52 are also plate-shaped and substantially rectangular in a side view. The side plates 52 are elongated in the front-to-rear direction and function to rotatably support both axial ends of the photosensitive drums 17. Hereinafter, the side plate 52 on the left side will be referred to as the left side plate 52L, and the side plate 52 on the right side will be referred to as the right side plate 52R when it is necessary to distinguish between the two. Support plates 54 are provided on each of the side plates 52 at positions opposing each other in the left-to-right direction. One pair of left and right support plates 54 is provided for each developer cartridge 15, for a total of four pairs.

The support plates 54 have flat plate shapes that protrude inward from the inner surfaces of the corresponding side plates 52. A cartridge guide groove 57 is formed in each support plates 54. Each cartridge guide groove 57 is cut out in the top edge of the support plate 54 near the corresponding photosensitive drum 17 and extends downward from this top edge. The cartridge guide grooves 57 are substantially U-shaped in a side view and have an open top. The cartridge guide grooves 57 function to receive cartridge guide ribs 106 (described later) provided on corresponding developer cartridges 15 in order to guide the developer cartridges 15 when the developer cartridges 15 are mounted in the process frame 14.

Three cartridge support grooves 59 are formed in each of the side plates 52 to correspond to the yellow developer cartridge 15Y, magenta developer cartridge 15M, and cyan developer cartridge 15C. Each of the cartridge support grooves 59 is positioned to overlap the corresponding cartridge guide groove 57 when projected in the left-to-right direction. Each cartridge support groove 59 is a cutout in the side plate 52 extending downward from the top edge thereof and is substantially U-shaped with an open top. The vertical dimension of the cartridge support grooves 59 is shorter than the corresponding cartridge guide grooves 57.

Four cartridge coupling holes 60 are formed in the right side plate 52R at positions overlapping the cartridge guide grooves 57 when projected in the left-to-right direction. The cartridge coupling holes 60 penetrate the right side plate 52R. The cartridge coupling hole 60 provided for the black developer cartridge 15K is formed as a circular hole, while the cartridge coupling holes 60 corresponding to the yellow developer cartridge 15Y, magenta developer cartridge 15M, and cyan developer cartridge 15C are formed as elongated holes extending vertically.

When the developer cartridges 15 are mounted in the process frame 14, cartridge couplings (not shown) provided for inputting a drive force into each of the developer cartridges 15 are exposed on the right side of the process frame 14 through the cartridge coupling holes 60.

As shown in FIG. 8, guide holes 78 and eccentric cam support holes 84 are formed in both side plates 52. The guide holes 78 are elongated holes extending vertically. One guide hole 78 penetrates the lower edge of each side plate 52 at a position forward of the black photosensitive drum 17K. The guide holes 78 function to receive a belt cleaning roller shaft 41 described later and to guide the belt cleaning roller shaft 41 when a belt cleaner 16 described later is pivoted. The eccentric cam support holes 84 are positioned below the respective guide holes 78 and are substantially circular in shape in a side view. The eccentric cam support holes 84 function to receive an eccentric cam pivot shaft 82 described later.

(2) Lift

The process unit 11 is provided with a lift 53 for conveying waste toner upward.

As shown in FIGS. 2(*a*) and 3, the lift 53 is fixed relative to the left side plate 52L at a position on the left side of the left side plate 52L near the front end thereof. The lift 53 includes seven second waste toner retaining parts 71, blade members 72, a lift-side relaying part 85, a shutter 102, and a lift-side coupling part 73.

Each of the second waste toner retaining parts 71 is hollow and formed in a substantially columnar shape extending in the left-to-right direction. The second waste toner retaining parts 71 are coupled to each other in a pattern that zigzags from bottom to top, so as to overlap each other in the front-to-rear direction. More specifically, the seven second waste toner retaining parts 71 are sequentially coupled to one another from bottom to top so that each successive (upper) second waste toner retaining part 71 is coupled to the previous (lower) second waste toner retaining part 71 at a position diagonally above and forward or diagonally above and rearward of the previous second waste toner retaining part 71.

The bottommost second waste toner retaining part 71 is rotatably supported on the left end of a first screw 27 described later and shares the axis of this first screw 27. Each of the blade members 72 is disposed in one of the second waste toner retaining parts 71 and includes a blade shaft 74, and a blade 75. The blade shaft 74 is inserted into the corresponding second waste toner retaining part 71 and is capable of rotating relative to the second waste toner retaining part 71. The blade shaft 74 shares the same central axis as the second waste toner retaining part 71. While not shown in the drawings, a seal is provided between the second waste toner retaining part 71 and blade shaft 74 for preventing toner leakage.

Two blades 75 are integrally provided with the blade shaft 74 in each second waste toner retaining part 71 and extend radially outward from the blade shaft 74. The length of the blades 75 in the radial direction of the blade shaft 74 is set so that the distal ends of the blades 75 contact the inner peripheral surface of the second waste toner retaining part 71. The width of the blades 75 in the left-to-right direction is substantially equivalent to the interior dimension of the second waste toner retaining part 71 in the left-to-right direction.

In the bottommost second waste toner retaining part 71, the blades 75 are integrally provided on the left end of a first screw 27 (described later) disposed in the second waste toner retaining part 71, where the blade shaft 74 serves as the shaft of the first screw 27.

The lift-side relaying part 85 is disposed diagonally above and forward of the topmost second waste toner retaining part 71 and is substantially U-shaped in a cross section, opening in a direction diagonally upward and forward. A lift-side through-hole 86 that is substantially rectangular in a front view is formed in the rear edge of the lift-side relaying part 85 and communicates with the topmost second waste toner retaining part 71. A shutter support hole 90 is formed in the left wall of the lift-side relaying part 85. The shutter support hole 90 penetrates the left wall of the lift-side relaying part 85 in the left-to-right direction and functions to receive a support boss 108 (described later) provided on the shutter 102. The lift-side relaying part 85 receives a shutter part 100 of a stopcock 94 described later on the top side thereof.

As shown in FIG. 2(*b*), the shutter 102 is formed in a partially cylindrical shape and is substantially fan-shaped in a side view. Specifically, the shutter 102 is integrally provided with a support part 87 that is substantially fan-shaped in a side view, with a center angle of approximately 120 degrees, a support boss 108 that protrudes leftward from the center point of the center angle formed by the support part 87, and a cover part 88 extending rightward from the arc-shaped edge of the support part 87. A fitting hole 89 is formed in the front edge of the cover part 88 near the support part 87. The fitting hole 89 extends in the left-to-right direction and receives a fitting protrusion 107 described later.

The shutter 102 is accommodated in the lift-side relaying part 85 such that the support boss 108 is rotatably inserted in the shutter support hole 90 and the outer surface of the cover part 88 confronts the inner surface of the lift-side relaying part 85. With this configuration, the shutter 102 can pivot about the support boss 108 between a closed position shown in FIG. 9 in which the cover part 88 confronts the lift-side through-hole 86 in the front-to-rear direction, and an open position shown in FIG. 8 in which the cover part 88 is disposed below the lift-side through-hole 86.

As shown in FIG. 3, the lift-side coupling part 73 is formed continuously with the right edge of the bottommost second waste toner retaining part 71 and protrudes rightward. The lift-side coupling part 73 has a cylindrical shape with a slightly smaller diameter than that of a cleaner-side coupling part 63 described later. Further, the lift-side coupling part 73 is fixedly (i.e., non-rotatably) inserted from the left side into a through-hole (not shown) formed in the lower edge of the left side plate 52L and protrudes rightward from the right side surface of the left side plate 52L. A second sealing member 77 is fixed to the outer peripheral surface of the portion of the lift-side coupling part 73 protruding rightward from the left side plate 52L.

(3) Belt Cleaner

The process unit 11 also includes a belt cleaner 16 that functions to clean waste toner deposited on the surface of the conveying belt 30.

As shown in FIGS. 1 and 3, the belt cleaner 16 includes a casing 23, a belt cleaning roller 24, a relay roller 25, a first waste toner retaining unit 26, and a first screw 27.

The casing 23 is formed in a box shape elongated in the left-to-right direction. The belt cleaning roller 24 is accommodated in the casing 23 with its axis oriented in the left-to-right direction. The lower end of the belt cleaning roller 24 is exposed beneath the casing 23 through the rear end of the casing 23. The lower edge of the belt cleaning roller 24 contacts the conveying belt 30.

The belt cleaning roller 24 also includes a belt cleaning roller shaft 41, and an outer layer 42 covering the belt cleaning roller shaft 41. The belt cleaning roller shaft 41 is formed with a greater left-to-right length than that of the process frame 14. The belt cleaning roller shaft 41 is rotatably supported in the casing 23 so as to protrude outward in left and right directions from the respective left and right sides of the casing 23.

The outer layer 42 is formed of a foam rubber or sponge material. The left-to-right length of the outer layer 42 is shorter than that of the belt cleaning roller shaft 41 so that the outer layer 42 is accommodated inside the casing 23. The relay roller 25 is accommodated in the casing 23 with its axis aligned in the left-to-right direction. The outer surface of the relay roller 25 contacts the belt cleaning roller 24 from a position diagonally above and forward therefrom. The relay roller 25 is rotatably supported in the casing 23.

The first waste toner retaining unit 26 is a space partitioned within the casing 23. The first screw 27 is disposed inside the first waste toner retaining unit 26 with its axis oriented in the left-to-right direction. The peripheral surface of the first screw 27 is formed as a left-hand thread.

As shown in FIG. 3, a gear cover 65 and a screw bearing 62 are provided on the right end of the belt cleaner 16, while a cleaner-side coupling part 63 is provided on the left side thereof.

The gear cover 65 is fixed to the right end face of the casing 23. The screw bearing 62 is cylindrical in shape and protrudes continuously rightward from the right surface of the gear cover 65. The screw bearing 62 is rotatably inserted through a through-hole (not shown) formed in the lower edge of the right side plate 52R and rotatably supports the right end of the first screw 27. The cleaner-side coupling part 63 is cylindrical in shape and protrudes continuously leftward from the left end face of the casing 23. A first sealing member 70 is fixed to the inner peripheral surface of the cleaner-side coupling part 63.

The cleaner-side coupling part 63 is rotatably fitted around the lift-side coupling part 73 so that the first sealing member 70 and second sealing member 77 are interposed between the cleaner-side coupling part 63 and lift-side coupling part 73 and form a seal between the cleaner-side coupling part 63 and lift-side coupling part 73.

The left and right ends of the belt cleaning roller shaft 41 are inserted through the guide holes 78 in the respective side plates 52 and rest on the bottom edges thereof. Thus, the belt cleaning roller shaft 41 is held in the process frame 14 at a position farther forward than the forwardmost black developer cartridge 15K.

A first compression spring 79 is provided in the process frame 14 between the front edge of the casing 23 and the front beam 55. The rear end of the first compression spring 79 is coupled to the casing 23, while the front end is coupled to the front beam 55. Through this construction, the belt cleaner 16 is constantly urged in a rearward direction. In other words, the belt cleaner 16 is constantly urged to rotate counterclockwise in a left side view about the axis of the first screw 27.

(4) Eccentric Cams

As shown in FIG. 8, the process unit 11 includes a pair of left and right eccentric cams 80.

Each of the eccentric cams 80 is configured of a flat plate that is elliptical in a side view. The eccentric cams 80 are disposed beneath the corresponding guide holes 78 on the inside of the respective side plates 52 relative to the left-to-right direction. The eccentric cams 80 oppose each other in the left-to-right direction at a distance greater than the left-to-right length of the casing 23 provided in the belt cleaner 16. The eccentric cams 80 contact the lower edge of the belt cleaning roller shaft 41.

Further, a through-hole is formed in the front end of each eccentric cam 80 when the eccentric cams 80 are positioned as shown in FIG. 8. An eccentric cam pivot shaft 82 is fixedly (i.e., non-rotatably) inserted through the through-holes in the eccentric cams 80.

Both left and right ends of the eccentric cam pivot shaft 82 are rotatably supported in the eccentric cam support holes 84 of both side plates 52. The eccentric cams 80 can move between a release position shown in FIG. 11 in which the eccentric cams 80 are oriented horizontally in the front-to-rear direction and do not press against the belt cleaning roller shaft 41, and a pressing position shown in FIG. 16 in which the eccentric cams 80 are oriented vertically and press the belt cleaning roller shaft 41 upward.

Figure 11:
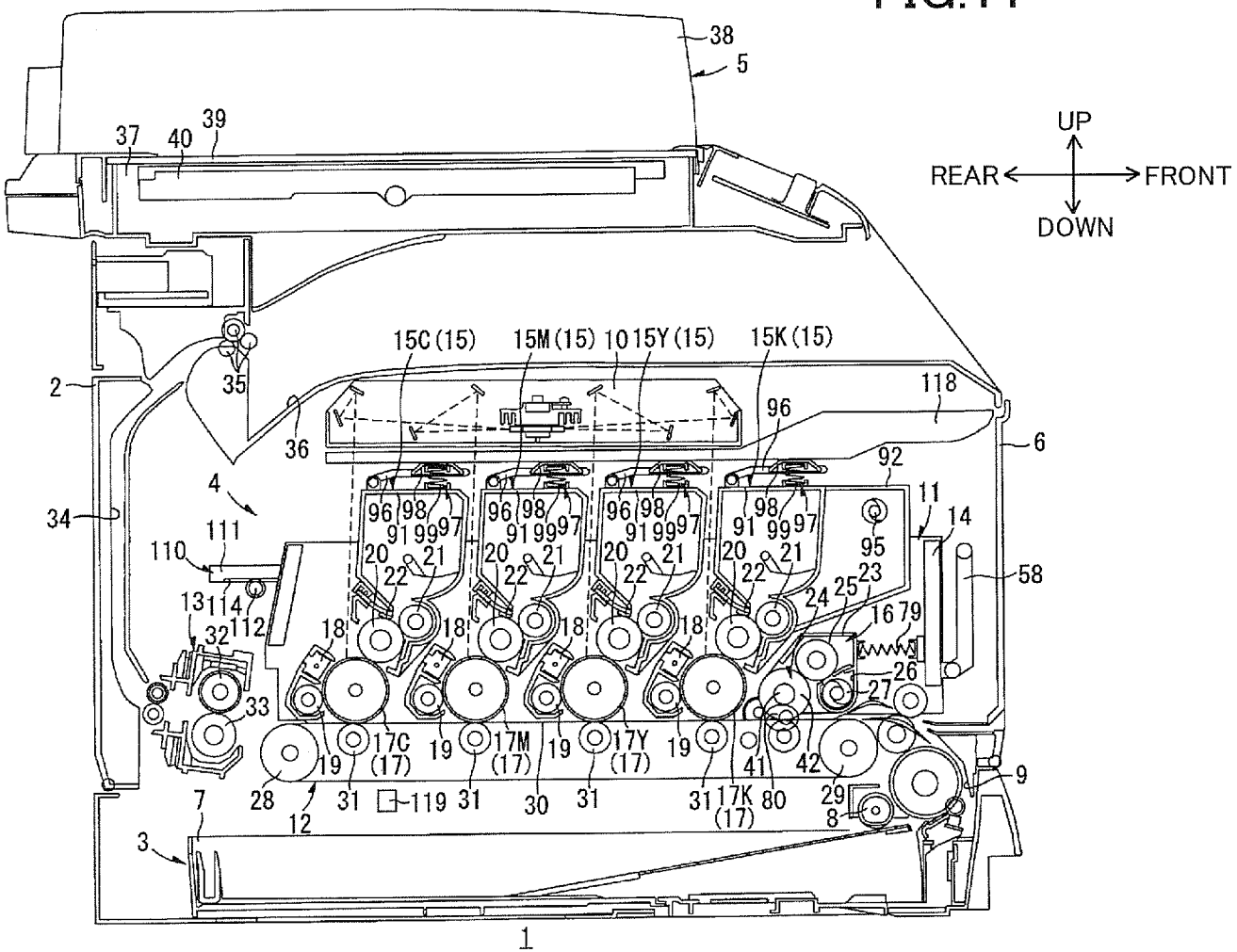
FIG. 11 is a side cross-sectional view illustrating the process frame after mounted into the main casing.
Figure 16:
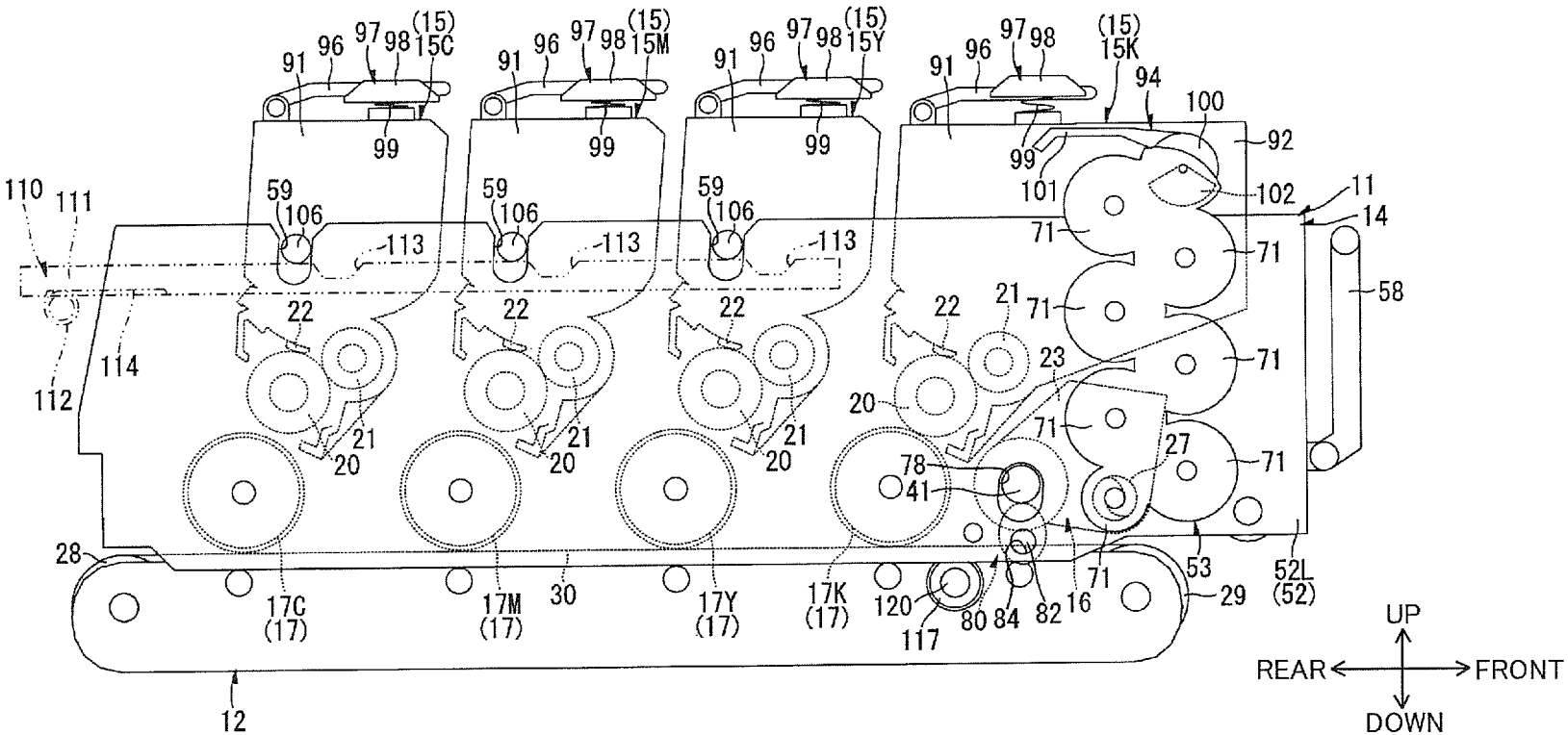
FIG. 16 is a side view of the process unit in a state shown in FIG. 15.

Through this construction, the belt cleaning roller 24 of the belt cleaner 16 pivots between a contact position shown in FIG. 11 in which the belt cleaning roller shaft 41 of the belt cleaning roller 24 is not pressed upward, and a separated position shown in FIG. 16 in which the belt cleaning roller shaft 41 of the belt cleaning roller 24 is pressed upward by the eccentric cams 80 so that the belt cleaning roller 24 is separated from the conveying belt 30. Since the first screw 27 shares its axis with the cleaner-side coupling part 63, the belt cleaner 16 pivots between the contact position and separated position about the axis of the first screw 27. In other words, the belt cleaning roller 24 is separated from the conveying belt in accordance with the rotation of the first toner retaining unit 26. In this time, the first waste toner retaining unit 26 rotates about the axis independently of both the first screw 27 and the waste toner accommodating section 92.

(5) Developer Cartridges

Figure 4:
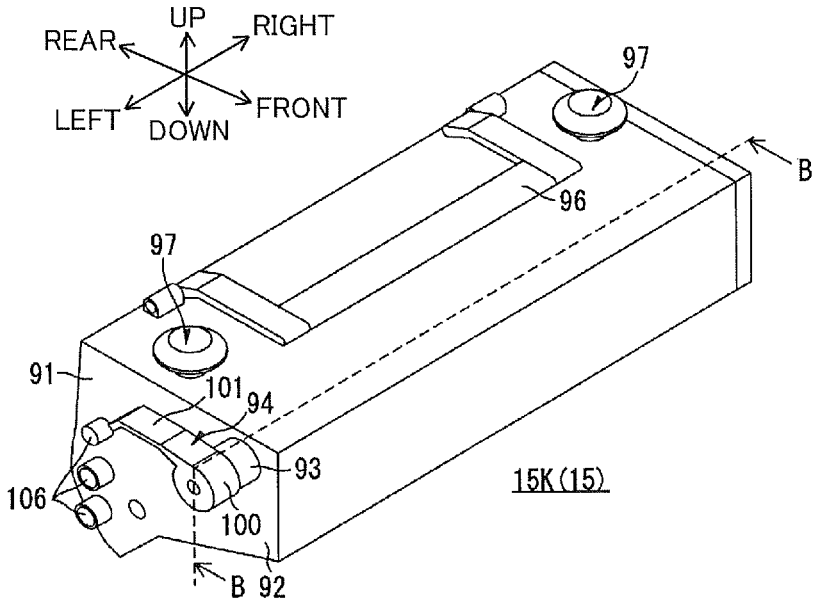
FIG. 4 is a perspective view of a black developer cartridge.
Figure 5:
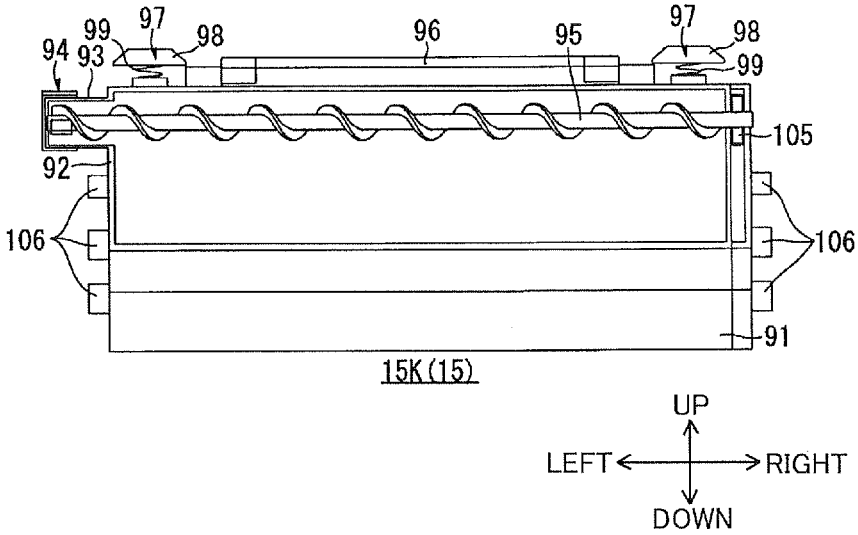
FIG. 5 is a cross-sectional view of the black developer cartridge taken along the line B-B shown in FIG. 4.
Figure 6:
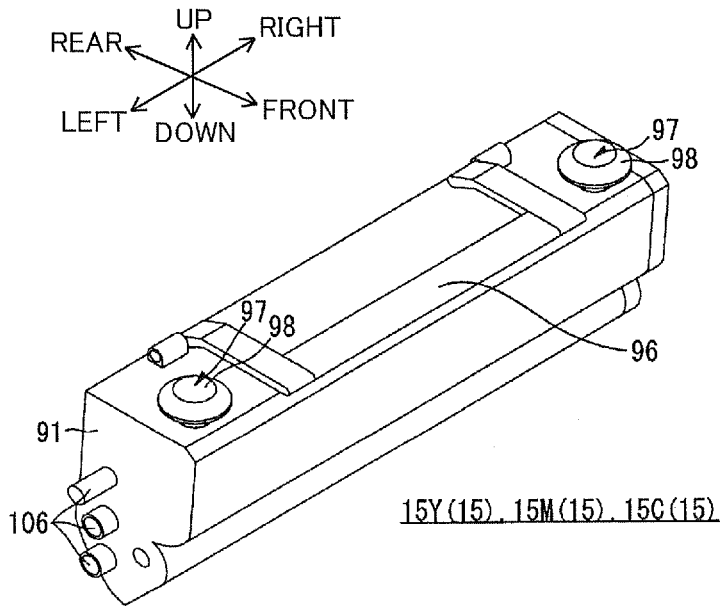
FIG. 6 is a perspective view of one of non-black developer cartridges.

FIG. 4 is a perspective view of the black developer cartridge 15K shown in FIG. 1. FIG. 5 is a cross-sectional view of the black developer cartridge 15K taken along the line B-B shown in FIG. 4. FIG. 6 is a perspective view of one of the non-black developer cartridge 15 in FIG. 1.

As shown in FIGS. 1 and 4, the black developer cartridge 15K is formed in a box shape that is elongated in the left-to-right direction. The black developer cartridge 15K includes a developer case 91, and a waste toner accommodating section 92.

The developer case 91 is formed in a box shape that is elongated in the left-to-right direction. The developing roller 20, supply roller 21, and thickness-regulating blade 22 are supported in the lower portion of the developer case 91, while toner is accommodated in the upper portion thereof. The developer case 91 also includes a cartridge handle 96, a pair of left and right urging members 97, and three pairs of left and right cartridge guide ribs 106.

The cartridge handle 96 is provided on the top surface of the developer case 91. The user grips the cartridge handle 96 when mounting the black developer cartridge 15K or removing the black developer cartridge 15K from the process frame 14.

The urging members 97 are disposed on the top surface of the developer case 91 and are separated from each other in the left-to-right direction, with one urging member 97 on either side of the cartridge handle 96. Each urging member 97 is configured of a substantially disc-shaped contact member 98, and a second compression spring 99 disposed between the contact member 98 and the top surface of the developer case 91. The upper end of the second compression spring 99 is coupled to the contact member 98, while the lower end is coupled to the top surface of the developer case 91. Accordingly, the second compression springs 99 constantly urge the contact members 98 upward.

The cartridge guide ribs 106 are cylindrical in shape and produce outward from the left and right side surfaces of the developer case 91. The cartridge guide ribs 106 are juxtaposed vertically on each side. As shown in FIG. 5, the waste toner accommodating section 92 is integrally provided on the front side of the developer case 91 and includes an accommodating-section-side relay part 93, a stopcock 94, and a second screw 95. The waste toner accommodating section 92, belt cleaner 16, and lift 53 together constitute a cleaning unit. Accordingly, the cleaning unit is disposed above the conveying belt 30.

The accommodating-section-side relay part 93 is formed continuously with the left side of the waste toner accommodating section 92 near the top edge thereof. The accommodating-section-side relay part 93 is hollow and cylindrical in shape and protrudes leftward from the left side of the waste toner accommodating section 92. The right end of the accommodating-section-side relay part 93 is in communication with the waste toner accommodating section 92 in the left-to-right direction. Further, an accommodating-section-side through-hole 104 (see FIG. 8) is formed in the left edge of the accommodating-section-side relay part 93 on the rear side thereof. The accommodating-section-side through-hole 104 penetrates the accommodating-section-side relay part 93 in the front-to-rear direction.

The stopcock 94 is pivotably provided on the left end of the accommodating-section-side relay part 93 and includes a shutter part 100, a grip part 101, and operating-part-side through-hole 103. The shutter part 100 constitutes the front portion of the stopcock 94. The shutter part 100 has a hollow cylindrical shape that is open on the right side. The shutter part 100 is rotatably fitted around the left end of the accommodating-section-side relay part 93. A fitting protrusion 107 is formed on a side of the shutter part 100 opposite the grip part 101 along a radial to the shutter part 100 (see FIG. 8).

The fitting protrusion 107 protrudes radially outward from the outer peripheral surface of the shutter part 100 and extends along the left-to-right direction. The grip part 101 has a flat plate shape that is substantially rectangular in a plan view. The grip part 101 is formed continuously with the top edge of the shutter part 100 and extends rearward therefrom. In a side view, the rear end of the grip part 101 is bent downward toward the rear.

The operating-part-side through-hole 103 is formed in the shutter part 100 below the grip part 101 and penetrates the shutter part 100 in the front-to-rear direction. The stopcock 94 can move between a horizontal position in which the shutter part 100 is in the open position shown in FIG. 8 for allowing communication between the accommodating-section-side relay part 93 and the lift 53, and a vertical position in which the shutter part 100 is in the closed position shown in FIG. 9 in which the shutter part 100 blocks communication between the accommodating-section-side relay part 93 and the lift 53.

As shown in FIG. 5, the second screw 95 is disposed in the upper section of the waste toner accommodating section 92 with its axis extending in the left-to-right direction and common to the axis of the accommodating-section-side relay part 93. A right-hand thread is formed on the outer peripheral surface of the second screw 95. The right end of the second screw 95 is rotatably supported in the right side of the waste toner accommodating section 92, while the left end is rotatably supported in the left end of the accommodating-section-side relay part 93.

A second screw gear 105 is fixedly (i.e., non-rotatably) provided on the right end of the second screw 95 in the right side of the waste toner accommodating section 92. When a drive force generated on the main casing 2 side is inputted into a developer coupling (not shown), this drive force is transmitted to the second screw gear 105 via a gear train (not shown), driving the second screw gear 105 to rotate counterclockwise in a left side view.

The second screw 95, first screw 27, and lift 53 together constitute a conveying member. Thus, the conveying member is retained in the process frame 14. As shown in FIG. 6, the non-black developer cartridges 15 are formed similar to the black developer cartridge 15K, except the non-black developer cartridges 15 do not have a waste toner accommodating section 92, and the topmost cartridge guide ribs 106 on both sides are formed longer than the topmost cartridge guide ribs 106 of the black developer cartridge 15K.

(6) Mounting the Developer Cartridges in the Process Frame

Figure 7:
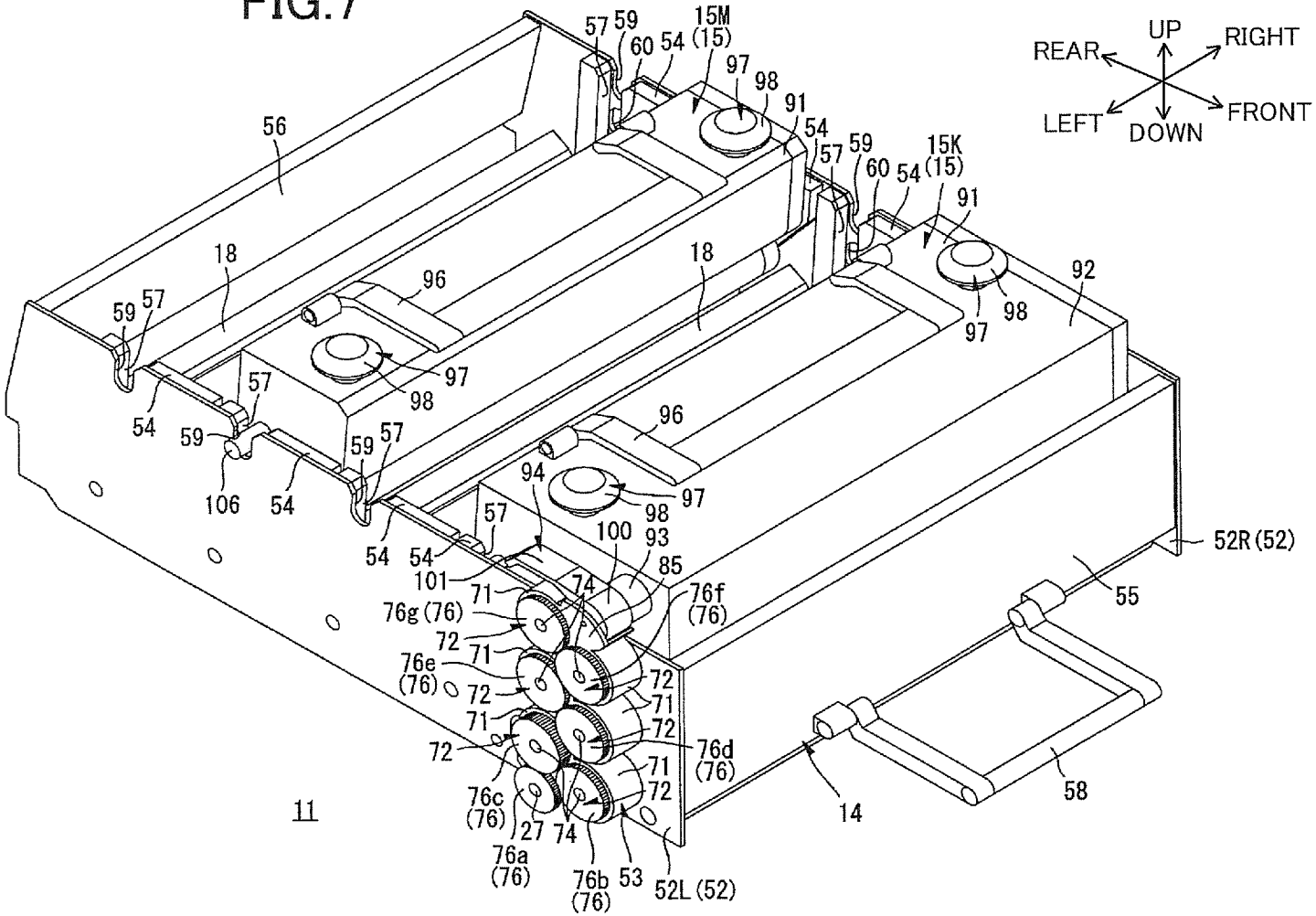
FIG. 7 is a perspective view illustrating how the developer cartridges are mounted in the process frame.
Figure 9:
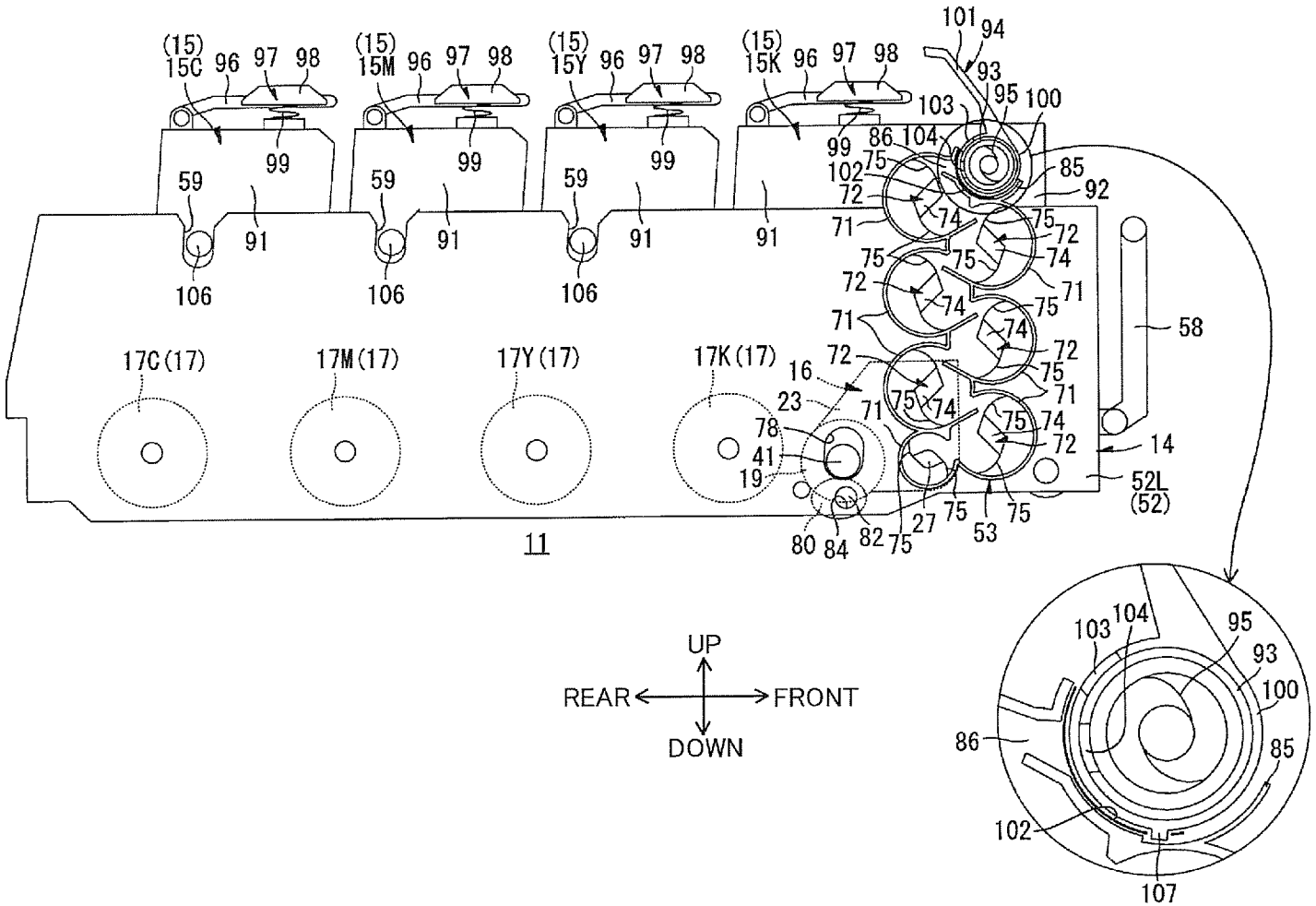
FIG. 9 illustrates operations of the stopcock.

FIG. 7 is a perspective view illustrating how the developer cartridges 15 shown in FIGS. 4 and 6 are mounted in the process frame 14. In FIG. 7, the black developer cartridge 15K and magenta developer cartridge 15M are currently mounted in the process frame 14. FIG. 9 illustrates the operations of the stopcock 94 shown in FIG. 4. In FIG. 9, the stopcock 94 is vertical so that the shutter part 100 is in the open position.

Prior to mounting the black developer cartridge 15K in the process frame 14, the stopcock 94 on the black developer cartridge 15K is in the vertical position, and the shutter 102 of the lift 53 is in the closed position. To mount the black developer cartridge 15K in the process frame 14, the operator grips the cartridge handle 96 of the black developer cartridge 15K, aligns the black developer cartridge 15K, and inserts the black developer cartridge 15K down into the process frame 14 so that all cartridge guide ribs 106 are fitted into the cartridge guide grooves 57 and the shutter part 100 of the stopcock 94 is fitted into the lift-side relaying part 85.

The black developer cartridge 15K is completely mounted in the process frame 14 when the developing roller 20 contacts the photosensitive drum 17. In order to mount one of the non-black developer cartridges 15 into the process frame 14, the operator grips the cartridge handle 96 of the developer cartridge 15 and positions the developer cartridge 15 so that the developing roller 20 is exposed on the rear side. The operator then inserts the developer cartridge 15 down into the process frame 14 so that all cartridge guide ribs 106 are fitted into the corresponding cartridge guide grooves 57.

The non-black developer cartridge 15 is completely mounted in the process frame 14 when the developing roller 20 contacts the photosensitive drum 17. At this time, the shutter part 100 of the stopcock 94 is fitted into the lift-side relaying part 85 and relays between the lift-side relaying part 85 and accommodating-section-side relay part 93, as shown in FIG. 9.

Further, the fitting protrusion 107 of the stopcock 94 is fitted downward into the fitting hole 89 of the shutter 102 (FIG. 2(*b*)). Through this engagement, the shutter 102 moves together with the stopcock 94.

When the stopcock 94 is rotated from its vertical position to the horizontal position, as shown in FIG. 8, the shutter part 100 of the stopcock 94 rotates counterclockwise in a left side view from the closed position to the open position. Accordingly, the operating-part-side through-hole 103 is moved downward to allow communication between the operating-part-side through-hole 103 and accommodating-section-side through-hole 104 in the front-to-rear direction. At the same time, the shutter 102 rotates together with the stopcock 94 counterclockwise in a left side view from the closed position to the open position in which the shutter 102 is below the lift-side through-hole 86.

At this time, the lift-side through-hole 86, operating-part-side through-hole 103, and accommodating-section-side through-hole 104 are aligned in the front-to-rear direction. In other words, the shutter 102 is in the open position and allows communication between the accommodating-section-side relay part 93 and lift-side relaying part 85 via the operating-part-side through-hole 103. In order to remove the black developer cartridge 15K from the process frame 14, the operator lifts the grip part 101 upward so that the stopcock 94 is in the vertical position shown in FIG. 9.

Through this operation, the shutter part 100 of the stopcock 94 is rotated from the open position clockwise in a left side view, moving the operating-part-side through-hole 103 upward so that the inner surface of the shutter part 100 confronts the accommodating-section-side through-hole 104 in the front-to-rear direction. At the same time, the shutter 102 rotates together with the stopcock 94 from the open position clockwise in a left side view so that the shutter 102 is aligned with the lift-side through-hole 86 in the front-to-rear direction.

At this time, the shutter 102 is in the closed position for blocking communication between the accommodating-section-side relay part 93 and lift-side relaying part 85.

Next, while the stopcock 94 is in the vertical position, the operator pulls the black developer cartridge 15K upward and removes the black developer cartridge 15K from the process frame 14. Accordingly, the fitting protrusion 107 of the stopcock 94 is disengaged from the fitting hole 89 of the shutter 102, and the black developer cartridge 15K is completely removed from the process frame 14 while the shutter 102 remains in the closed position.

To remove any non-black developer cartridge 15 from the process frame 14, the operator simply pulls this developer cartridge 15 upward.

3. Detailed Description of the Main Casing

Figure 10:
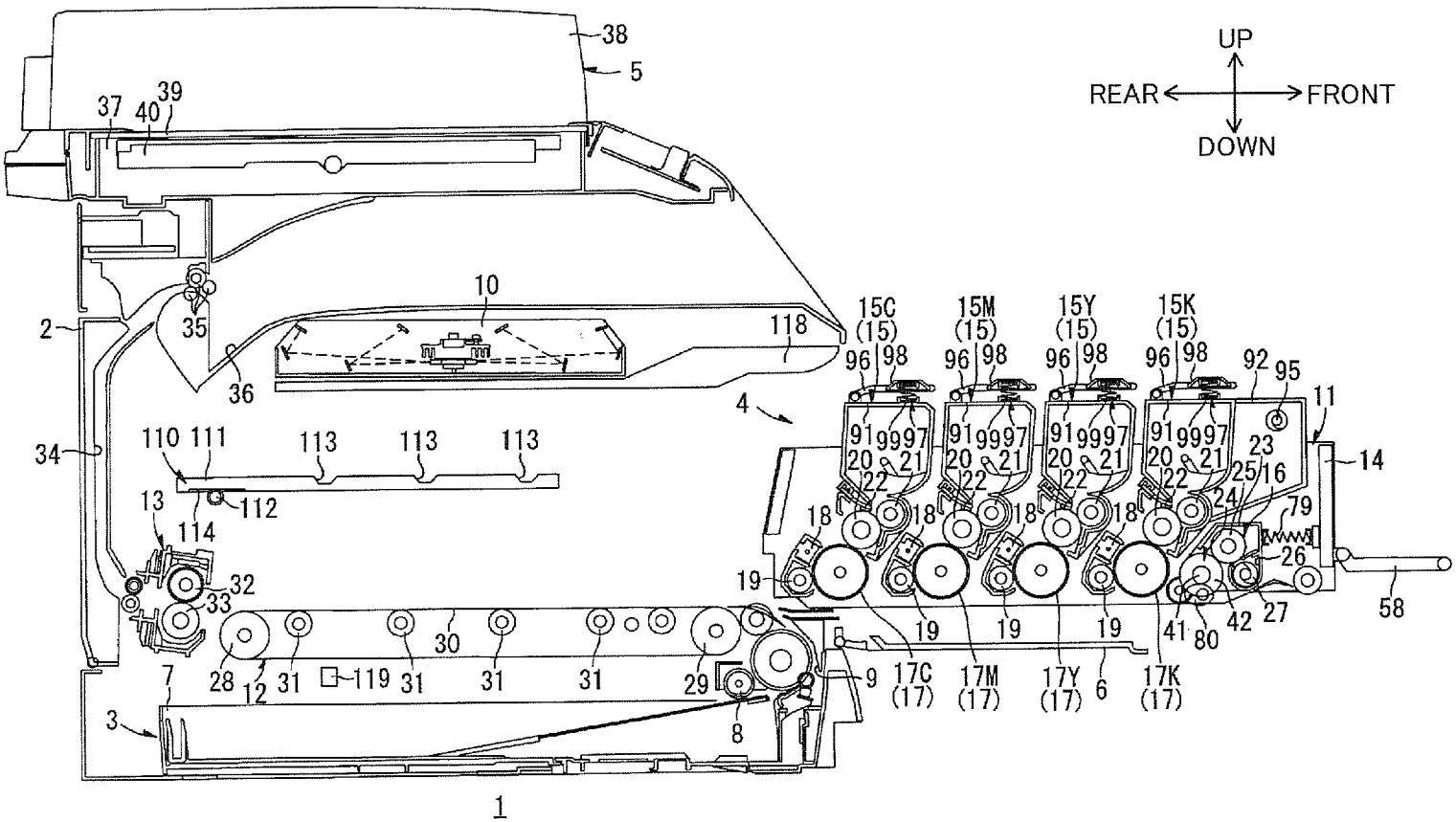
FIG. 10 is a side cross-sectional view illustrating the process frame before mounted into a main casing.
Figure 12:
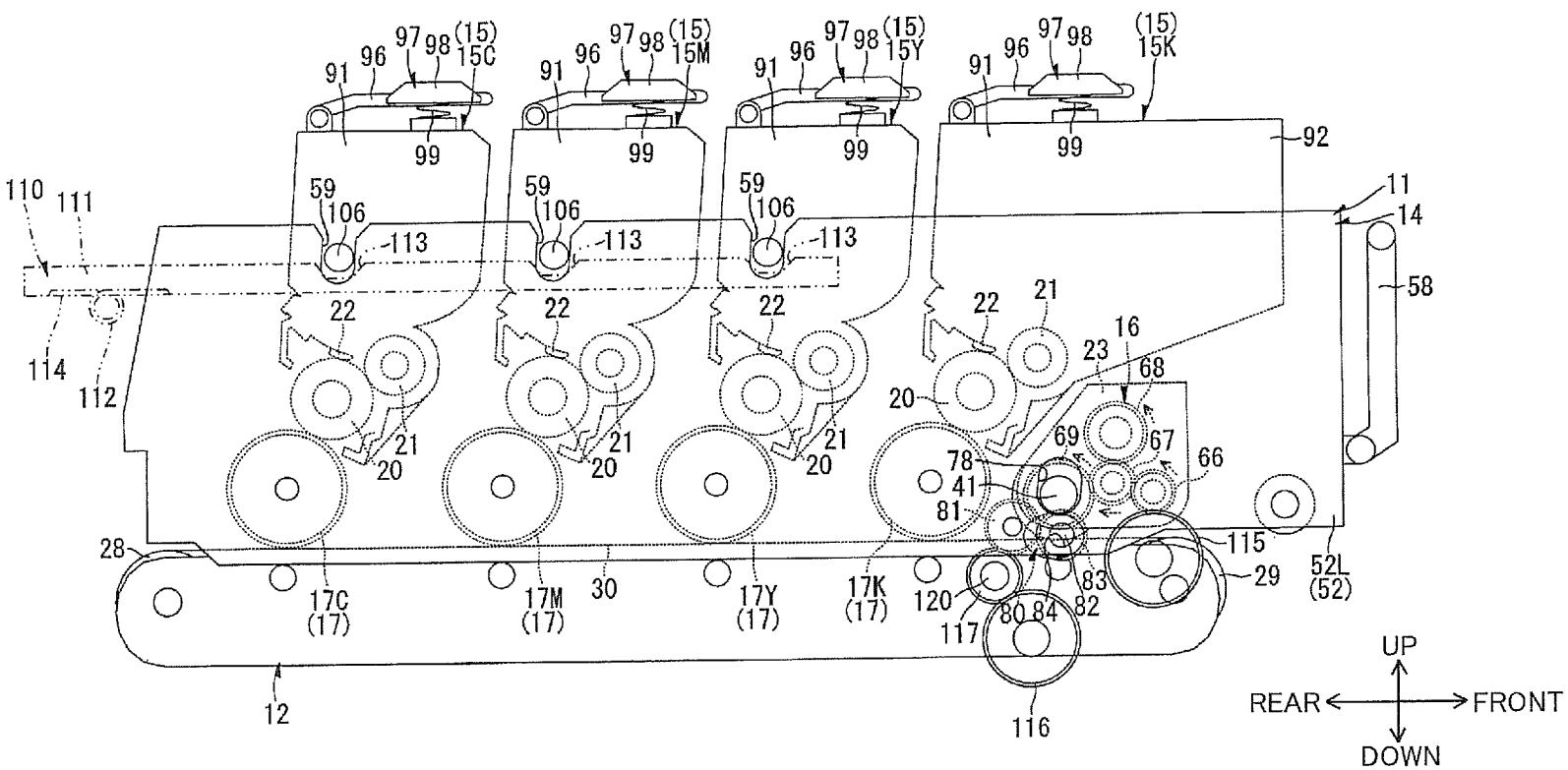
FIG. 12 is a side view of the process frame.

FIG. 10 is a side cross-sectional view illustrating the process of mounting the process frame 14 shown in FIG. 8 into the main casing 2 and shows the process frame 14 prior to mounting. FIG. 11 is a side cross-sectional view illustrating the process of mounting the process frame 14 in the main casing 2 and shows the process frame 14 after mounting when all of the developer cartridges 15 are in contact with the corresponding photosensitive drums 17 and the belt cleaning roller 24 is in contact with the conveying belt 30. FIG. 12 is a side view of the process frame 14 shown in FIG. 10.

(1) Structure of the Main Casing

As shown in FIGS. 10 and 12, the main casing 2 includes a translation cam mechanism 110, a first drive gear 115, a second drive gear 116, a pair of left and right second relay gears 117, a pair of left and right projections 118, and a patch sensor 119.

The translation cam mechanism 110 further includes a pair of left and right translation cams 111, and a pair of left and right translation cam drive gears 112. The translation cams 111 extending in the front-to-rear direction in inside the main casing 2, opposing each other in the left-to-right direction at a distance greater than the left-to-right dimension of the process unit 11. Each translation cam 111 includes three depressions 113, and a rack part 114.

The depressions 113 are formed in the top edges of the translation cams 111 at positions juxtaposed in the front-to-rear direction between a point near the rear edge of the translation cams 111 to a point in substantially the front-to-rear center thereof to correspond to the positions of the non-black developer cartridges 15. The front edge of each depression 113 slopes upward toward the front, while the rear edge slopes upward toward the rear.

The rack parts 114 are formed on the rear ends of the translation cams 111, extending in the front-to-rear direction along the lower edges thereof. The translation cam drive gears 112 are disposed beneath the respective translation cams 111 and are engaged in the corresponding rack parts 114. The translation cam drive gears 112 are also coupled to each other, although this structure is not shown in the drawings.

As shown in FIG. 12, the first drive gear 115 is disposed on the right front end of the transfer unit 12. The second drive gear 116 is disposed on the right side of the transfer unit 12 to the rear of the first drive gear 115. The second relay gears 117 are disposed one each on the left and right sides of the transfer unit 12. The second relay gears 117 are coupled to each other by a second relay gear coupling shaft 120 fixedly (i.e., non-rotatably) inserted into the centers of the second relay gears 117.

In other words, the right second relay gear 117 is disposed diagonally above and rearward of the second drive gear 116 and is engaged with the second drive gear 116. The second relay gears 117, first relay gears 81 described later, and the second drive gear 116 together constitute a drive transmission member that functions to transmit a drive force to the eccentric cams 80 for moving the eccentric cams 80 between the pressing position and the release position.

The projections 118 are formed on the bottom of the scanning unit 10, opposing each other at a distance in the left-to-right direction, and extend in the front-to-rear direction. The projections 118 are positioned so as to contact the urging members 97 of the developer cartridges 15 when the process unit 11 is mounted in the main casing 2.

The patch sensor 119 is disposed beneath the transfer unit 12 and confronts a rear end part of the transfer unit 12 vertically. The patch sensor 119 functions to read printed patterns formed directly on the conveying belt 30.

(2) Mounting the Process Unit in the Main Casing

In order to mount the process unit 11 in the main casing 2, the operator first opens the front cover 6 on the main casing 2, as shown in FIG. 10. Next, the operator inserts the rear end of the process unit 11 into the main casing 2.

Subsequently, the operator grips the frame handle 58 provided on the front of the process unit 11 and pushes the process unit 11 rearward until the process unit 11 is completely mounted in the main casing 2, as shown in FIG. 11. At this time, each of the photosensitive drums 17 contacts the top surface of the conveying belt 30 and confronts a respective transfer roller 31 through the conveying belt 30, as shown in FIG. 12. In addition, the urging members 97 on each developer cartridge 15 contact the bottom of the projections 118 formed in the main casing 2. Accordingly, the elastic force of the second compression springs 99 in the urging members 97 urges the developer cartridges 15 toward the photosensitive drums 17. Hence, each of the developing rollers 20 elastically contacts the corresponding photosensitive drum 17.

At this time, the eccentric cams 80 are in the release position. In other words, the eccentric cams 80 are oriented with their longer dimension aligned in the front-to-rear direction. Further, the belt cleaning roller 24 has pivoted together with the casing 23 counterclockwise in a left side view and is in the contact position. In addition, the topmost cartridge guide rib 106 on both sides of the non-black developer cartridges 15 is fitted into the corresponding depression 113 of the translation cam mechanism 110 from above.

(3) Gear Engagements

As shown in FIG. 3, a gear train 64 is provided in the gear cover 65.

As shown in FIGS. 3 and 12, the gear train 64 includes a first screw gear 66, a relay gear 67, a relay roller gear 68, and a cleaning roller gear 69. The first screw gear 66 is formed in a disc shape and is fixedly (i.e., non-rotatably) disposed on the right end of the first screw 27. The first screw gear 66 is engaged with the relay gear 67.

The relay gear 67 is also formed in a disc shape and is engaged with both the relay roller gear 68 and the cleaning roller gear 69. The relay roller gear 68 is formed in a disc shape and is fixedly (i.e., non-rotatably) disposed on the right end of the relay roller 25. The cleaning roller gear 69 is formed in a disc shape and is fixedly (i.e., non-rotatably) disposed on the right end of the belt cleaning roller 24.

As shown in FIGS. 2(*a*) and 3, the lift 53 includes seven blade gears 76 corresponding to each of the second waste toner retaining parts 71. Each blade gear 76 is fixedly (i.e., non-rotatably) disposed on the left end of one blade shaft 74 or the first screw 27 on the left side of the corresponding second waste toner retaining part 71. Specifically, the blade gears 76 include a bottommost first blade gear 76*a*, a second blade gear 76*b* disposed adjacent to the first blade gear 76*a* at a position diagonally above and forward therefrom, a third blade gear 76*c* disposed adjacent to the second blade gear 76*b* at a position diagonally above and rearward therefrom, a fourth blade gear 76*d* disposed adjacent to the third blade gear 76*c* at a position diagonally above and forward therefrom, a fifth blade gear 76*e* disposed adjacent to the fourth blade gear 76*d* at a position diagonally above and rearward therefrom, a sixth blade gear 76*f* disposed adjacent to the fifth blade gear 76*e* at a position diagonally above and forward therefrom, and a seventh blade gear 76*g* disposed adjacent to the sixth blade gear 76*f* at a position diagonally above and rearward therefrom. Here, the first blade gear 76*a* has a smaller diameter than the other blade gears 76, and the third blade gear 76*c* is formed twice as long in the left-to-right direction than the other blade gears 76.

The first blade gear 76*a* is engaged in the left edge portion of the third blade gear 76*c*, while the second blade gear 76*b* and fourth blade gear 76*d* are engaged in the right edge portion of the third blade gear 76*c*. The fourth blade gear 76*d* is also engaged with the fifth blade gear 76*e*, the fifth blade gear 76*e* with the sixth blade gear 76*f*, and the sixth blade gear 76*f* with the seventh blade gear 76*g*.

As shown in FIG. 12, eccentric cam gears 83 are integrally formed on the left and right outer surfaces of the corresponding eccentric cams 80. The eccentric cam gears 83 share a central axis with the eccentric cam pivot shaft 82. The process frame 14 also includes a pair of left and right first relay gears 81.

The first relay gears 81 are disposed to the rear of the corresponding eccentric cams 80 and are rotatably supported on the process frame 14. The first relay gears 81 are engaged with the corresponding eccentric cam gears 83 from the rear side thereof.

When the process unit 11 is completely mounted in the main casing 2, the first screw gear 66 of the belt cleaner 16 is engaged with the first drive gear 115 of the main casing 2 and the first relay gears 81 of the process frame 14 are engaged with the second relay gears 117 of the main casing 2.

(4) Drive Transmission for the Process Unit (4-1) Drive Transmission for the Belt Cleaner and Lift First, a drive force is inputted from a drive source (not shown) provided in the main casing 2 into the first drive gear 115 for rotating the first drive gear 115 clockwise in a left side view (hereinafter referred to as a "reverse rotation"). The first drive gear 115 transmits this drive force to the first screw gear 66 for rotating the first screw gear 66 counterclockwise in a left side view (hereinafter referred to as a "forward rotation").

The first screw gear 66 transmits this drive force via the relay gear 67 to the relay roller gear 68 and cleaning roller gear 69, driving the relay gear 67 in the reverse rotation and the relay roller gear 68 and cleaning roller gear 69 in the forward rotation. Hence, the first screw 27, relay roller 25, and belt cleaning roller 24 are driven in a forward rotation.

Further, the drive force inputted into the first screw gear 66 (drive force for a forward rotation) is transmitted via the first screw 27 to the first blade gear 76*a* provided on the left end of the first screw 27, driving the first blade gear 76*a* in a forward rotation (see FIG. 3). The first blade gear 76*a* then transmits the drive force via the third blade gear 76*c* to the second blade gear 76*b* and fourth blade gear 76*d* (see FIG. 2(*a*)), driving the third blade gear 76*c* in a reverse rotation and the second blade gear 76*b* and fourth blade gear 76*d* in a forward rotation.

The fourth blade gear 76*d* transmits the drive force via the fifth blade gear 76*e* and sixth blade gear 76*f* to the seventh blade gear 76*g* (see FIG. 2(*a*)), driving the fifth blade gear 76*e* in a reverse rotation, the sixth blade gear 76*f* in a forward rotation, and the seventh blade gear 76*g* in a reverse rotation.

(4-2) Drive Transmission for the Eccentric Cams

If a drive force for a forward rotation is inputted from a drive source (not shown) provided in the main casing 2 to the second drive gear 116, the second drive gear 116 transmits the drive force via the second relay gears 117 and first relay gears 81 to the eccentric cam gears 83. Accordingly, the second relay gears 117 are driven in a reverse rotation, the first relay gears 81 in a forward rotation, and the eccentric cam gears 83 in a reverse rotation.

If a drive force for a reverse rotation is inputted from the drive source into the second drive gear 116, the second drive gear 116 transmits the drive force to the eccentric cam gears 83 via the second relay gears 117 and first relay gears 81, driving the second relay gears 117 in a forward rotation, the first relay gears 81 in a reverse rotation, and the eccentric cam gears 83 in a forward rotation.

4. Operations of the Process Unit (1) Operation for Reading Printed Patterns

After the process unit 11 is mounted in the main casing 2, as shown in FIG. 11, the printer 1 forms printed patterns (patches) on the conveying belt 30 by directly transferring toner patterns onto the surface of the conveying belt 30 through the developing operation and transfer operation described above.

As the conveying belt 30 circulates, the printed patterns on the surface of the conveying belt 30 are conveyed to a position opposing the patch sensor 119 disposed below the transfer unit 12. At this time, the patch sensor 119 reads the printed patterns to measure positional deviations among colors and the densities of the printed images.

As the conveying belt 30 continues to circulate, the printed patterns are conveyed to a position opposite the belt cleaning roller 24. At this time, the toner constituting the printed patterns is transferred onto the peripheral surface of the belt cleaning roller 24 by a cleaning bias applied to the belt cleaning roller 24. Hence, the toner is captured on the belt cleaning roller 24.

This waste toner captured on the belt cleaning roller 24 is subsequently transferred to the first waste toner retaining unit 26 via the relay roller 25 and stored in the first waste toner retaining unit 26. This completes the operation for measuring positional deviations among colors and image densities.

(2) Operation for Recovering Waste Toner

Figure 13:
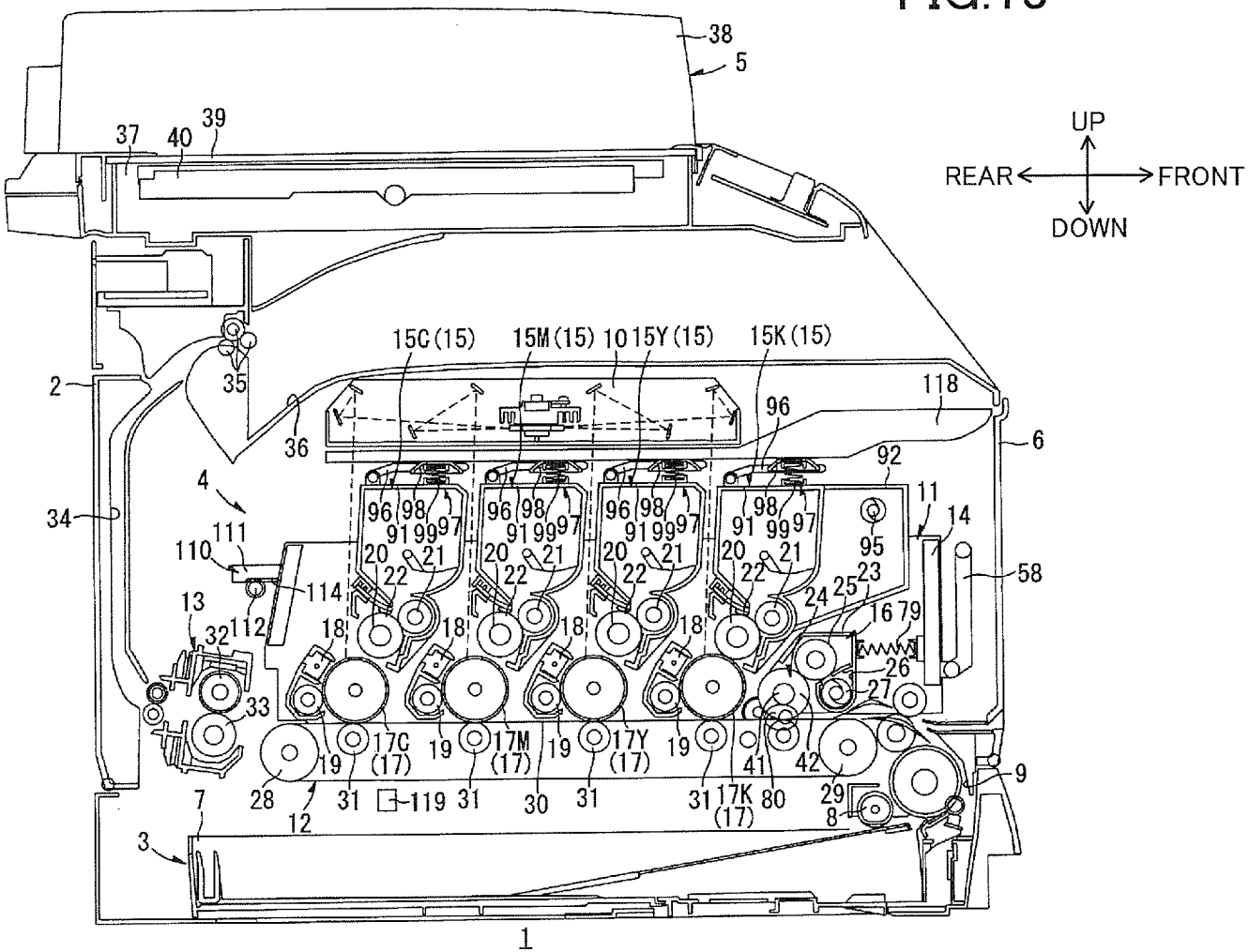
FIG. 13 is a side cross-sectional view illustrating an operation of the color laser printer for recovering waste toner.
Figure 14:
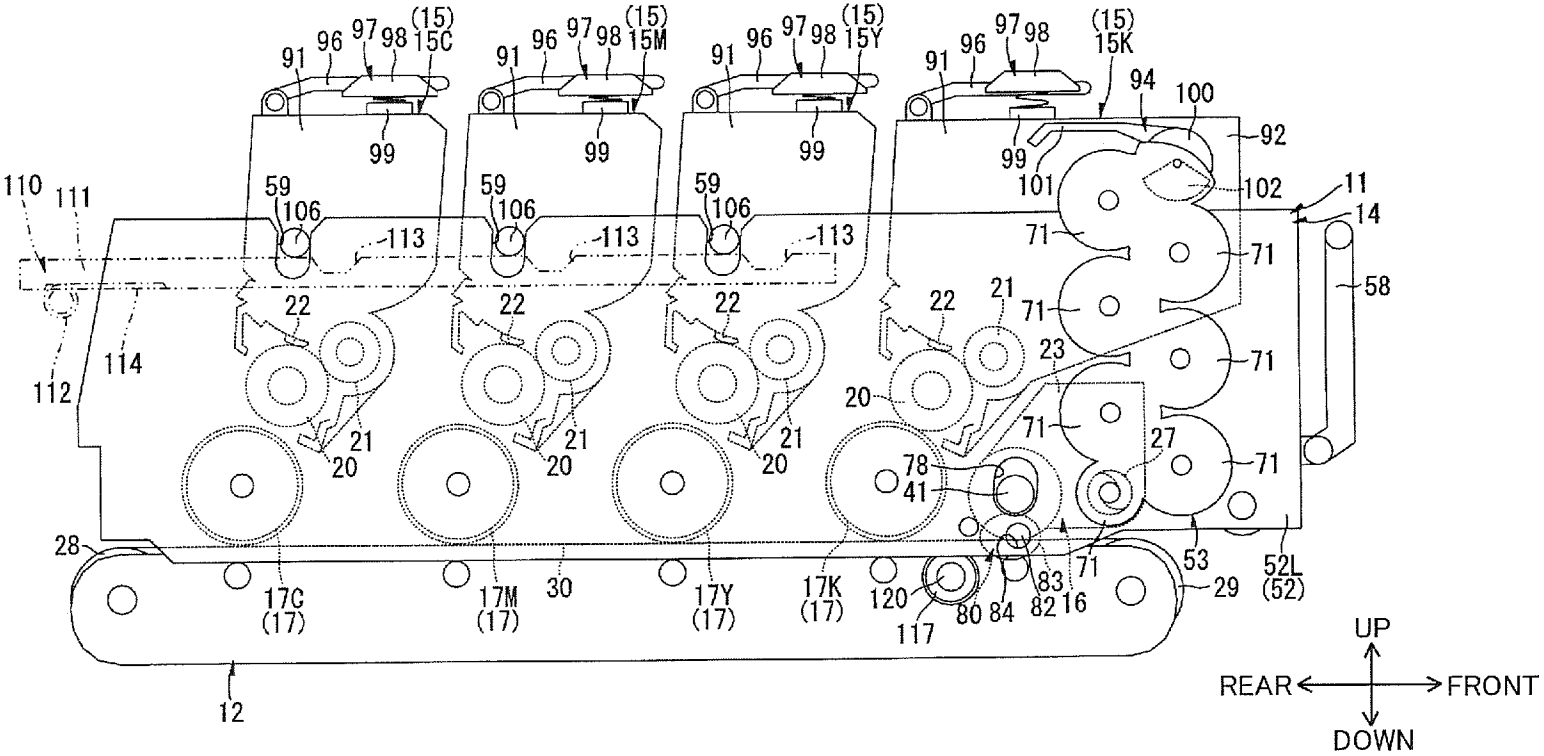
FIG. 14 is a side view of a process unit in a state shown in FIG. 13.
Figure 15:
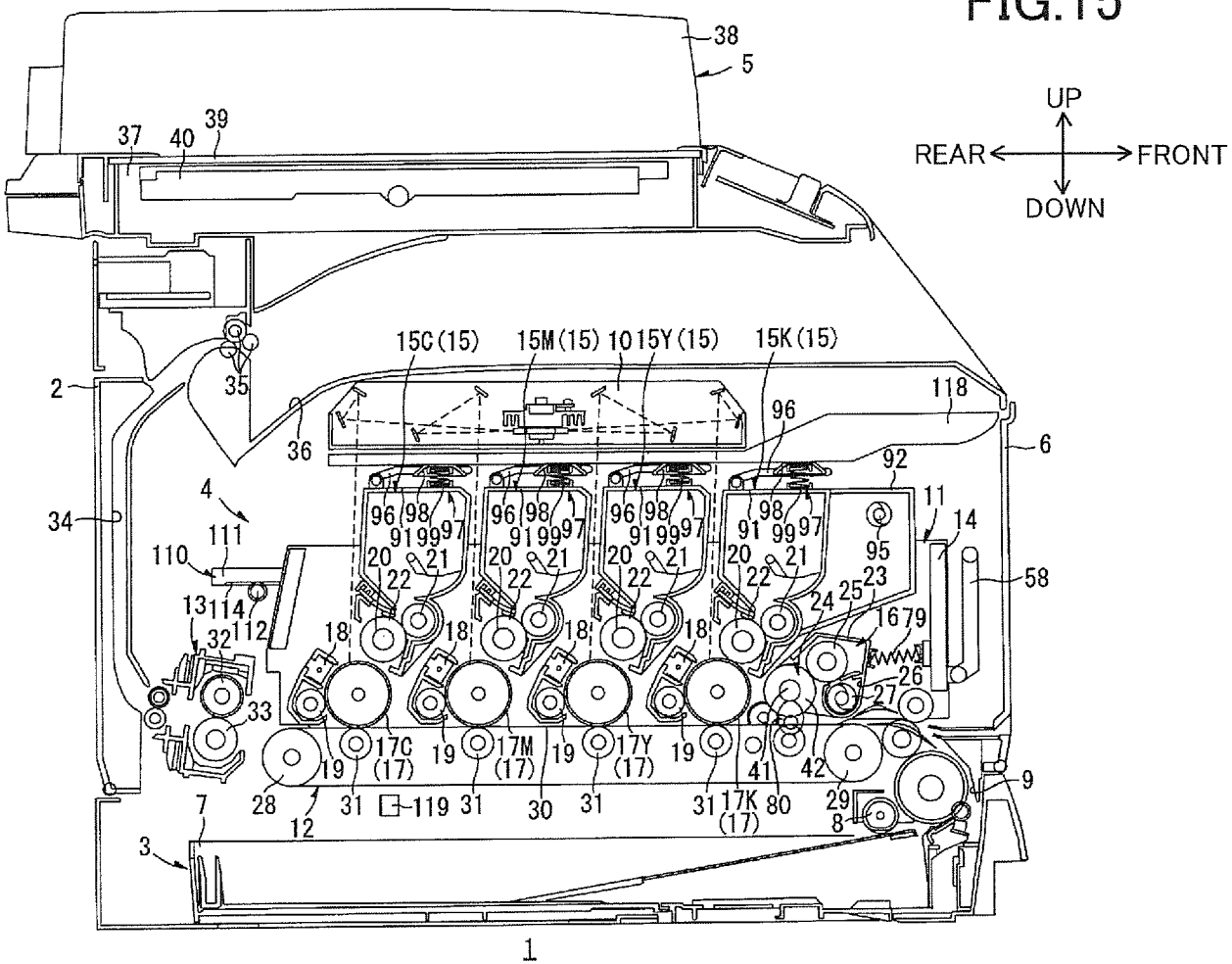
FIG. 15 is a side cross-sectional view illustrating an operation of the color laser printer for recovering waste toner.

FIG. 13 is a side cross-sectional view illustrating an operation of the printer 1 for recovering waste toner. In FIG. 13, all non-black developer cartridges 15 are separated from their respective photosensitive drums 17, while the belt cleaning roller 24 is in contact with the conveying belt 30. FIG. 14 is a side view of the process unit 11 shown in FIG. 13. FIG. 15 is a side cross-sectional view of the printer 1 in a monochrome mode in which all non-black developer cartridges 15 are separated from their respective photosensitive drums 17 and the belt cleaning roller 24 is separated from the conveying belt 30.

In some cases, residual toner remains on the peripheral surfaces of the photosensitive drums 17 after the toner patterns have been transferred onto the surface of the conveying belt 30. Therefore, when the residual waste toner is brought opposite the drum-cleaning roller 19 by the rotation of the photosensitive drum 17, the waste toner is transferred onto the peripheral surface of the drum-cleaning roller 19 owing to a cleaning bias applied to the drum-cleaning roller 19 and is temporarily retained on the drum-cleaning roller 19.

After the printer 1 has measured positional deviations among colors and image densities, the waste toner captured on the drum-cleaning rollers 19 is also recovered prior to performing image-forming operations. This process is referred to as a "waste toner recovery operation" herein. In order to recover waste toner, the non-black developer cartridges 15 are separated from their corresponding photosensitive drums 17 while the black developer cartridge 15K remains fixed in contact with the black photosensitive drum 17K, as shown in FIG. 13.

In order to separate the non-black developer cartridges 15 from their respective photosensitive drums 17, the translation cam drive gears 112 are rotated clockwise in a left side view, moving the translation cams 111 forward. At this time, as illustrated in FIG. 14, the topmost cartridge guide ribs 106 on the non-black developer cartridges 15 are pushed upward along the sloped rear edges of the depressions 113 formed in the left and right translation cams 111. Consequently, the non-black developer cartridges 15 are lifted upward against the urging force of the urging members 97.

When the non-black developer cartridges 15 are lifted upward, the developing rollers 20 in the non-black developer cartridges 15 separate from the corresponding photosensitive drums 17. Next, a bias having opposite polarity to the cleaning bias is applied to the drum-cleaning rollers 19. This bias causes the waste toner temporarily carried on the drum-cleaning rollers 19 to be repelled back to the corresponding photosensitive drums 17 and discharged onto the conveying belt 30.

As the conveying belt 30 circulates, the waste toner discharged on the surface of the conveying belt 30 is circulated along the bottom of the transfer unit 12 and brought back to a position opposite the belt cleaning roller 24. At this time, the toner discharged from the drum-cleaning rollers 19 onto the conveying belt 30 is captured on the belt cleaning roller 24 by the cleaning bias applied thereto. The belt cleaning roller 24 subsequently transfers the toner to the first waste toner retaining unit 26 via the relay roller 25 to be stored in the first waste toner retaining unit 26.

As shown in FIG. 3, waste toner collected in the first waste toner retaining unit 26 is conveyed leftward by the rotation of the first screw 27 (counterclockwise rotation in a left side view) and is supplied to the bottommost second waste toner retaining part 71 in the lift 53. As shown in FIG. 8, waste toner supplied to the bottommost second waste toner retaining part 71 is conveyed upward along a zigzag path by the rotations of the blade members 72 disposed in the second waste toner retaining parts 71. The blade member 72 in the topmost second waste toner retaining part 71 supplies the waste toner to the accommodating-section-side relay part 93 through the lift-side through-hole 86, operating-part-side through-hole 103, and accommodating-section-side through-hole 104.

As shown in FIG. 5, waste toner supplied to the accommodating-section-side relay part 93 is conveyed rightward by the rotation of the second screw 95 (clockwise rotation in a left side view), and the waste toner is accumulated in the waste toner accommodating section 92. This completes the operation for collecting waste toner. Once all the waste toner has been collected, a drive source (not shown) provided in the main casing 2 inputs a drive force into the second drive gear 116 for driving the second drive gear 116 in a forward rotation.

As described above, the second drive gear 116 transmits the drive force to the eccentric cams 80, causing the eccentric cams 80 to rotate clockwise in a left side view to the pressing position in which the eccentric cams 80 press the belt cleaning roller shaft 41 upward. When the eccentric cams 80 press against the belt cleaning roller shaft 41, the belt cleaning roller shaft 41 is guided upward along the guide holes 78, causing the belt cleaner 16 to pivot clockwise in a left side view about the axis of the first screw 27 and against the urging force of the first compression spring 79.

Consequently, the belt cleaning roller 24 is moved into the separated position shown in FIG. 15 in which the belt cleaning roller 24 is separated from the conveying belt 30.

(3) Image-Forming Operation

Figure 17:
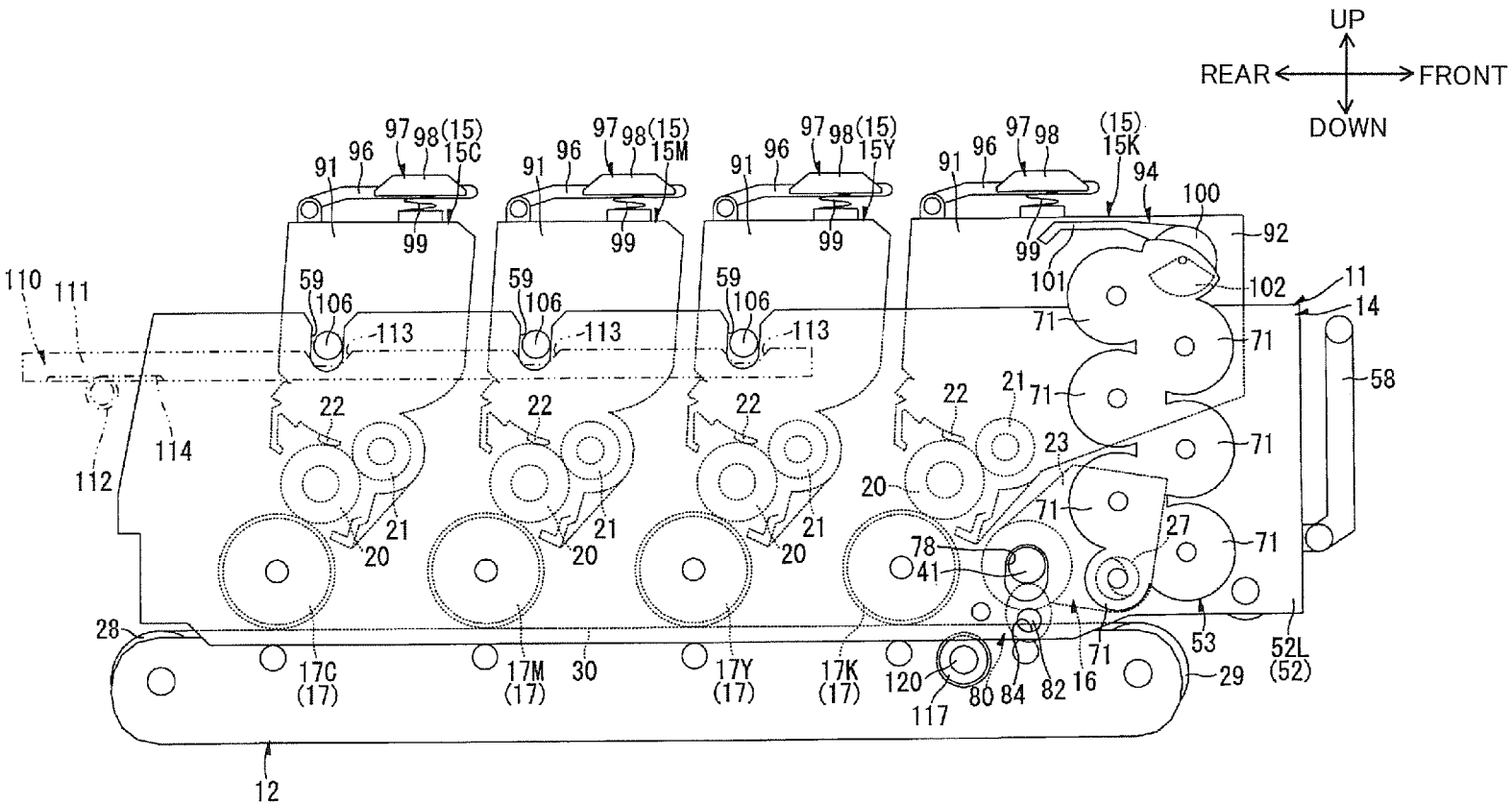
FIG. 17 is a side view of the process unit when the color laser printer is in a color mode.

FIG. 16 is a side view of the process unit 11 shown in FIG. 15. FIG. 17 is a side view of the process unit 11 when the printer 1 is in a color mode. In this mode, all developer cartridges 15 are in contact with their respective photosensitive drums 17, and the belt cleaning roller 24 is separated from the conveying belt 30.

When the belt cleaning roller 24 is separated from the conveying belt 30, the printer 1 is initially placed in the monochrome mode for forming images in black, as shown in FIG. 16. In the monochrome mode, the black developer cartridge 15K contacts the black photosensitive drum 17K, but the non-black developer cartridges 15 are separated from their respective photosensitive drums 17. Accordingly, the printer 1 can form images only in black toner.

In order to form color images, the non-black developer cartridges 15 are placed in contact with their respective photosensitive drums 17, as shown in FIG. 17. In order to place the non-black developer cartridges 15 in contact with the photosensitive drums 17, the translation cam drive gears 112 is rotated counterclockwise in a left side view, moving the translation cams 111 rearward.

At this time, the topmost cartridge guide ribs 106 on the non-black developer cartridges 15 slide down along the sloped rear edges of the depressions 113 formed in the left and right translation cams 111 and become fitted in the corresponding depressions 113. Consequently, the non-black developer cartridges 15 are moved downward by the urging force of the urging members 97, placing the developing rollers 20 of the non-black developer cartridges 15 in contact with their corresponding photosensitive drums 17. At this time, the printer 1 is in the color mode for forming color images.

In the color mode, the printer 1 can form color images because all developer cartridges 15 are in contact with all photosensitive drums 17. Once the image-forming operation described above is completed, a drive source (not shown) provided in the main casing 2 inputs a drive force for reverse rotation into the second drive gear 116. As described above the second drive gear 116 transmits this drive force to the eccentric cams 80, causing the eccentric cams 80 to rotate counterclockwise in a left side view into the release position. Thus, the eccentric cams 80 no longer apply pressure to the belt cleaning roller shaft 41.

Consequently, the urging force of the first compression spring 79 force the belt cleaner 16 to pivot counterclockwise in a left side view about the axis of the first screw 27, as the belt cleaning roller shaft 41 is guided downward along the guide holes 78. As a result, the belt cleaning roller 24 is placed in the contact position shown in FIG. 11 in which the belt cleaning roller 24 is in contact with the conveying belt 30. At this time, the belt cleaner 16 begins collecting waste toner according to the operation described above.

5. Operations and Effects (1) In the printer 1 according to the preferred embodiment, the cleaning unit configured of the belt cleaner 16, lift 53, and waste toner accommodating section 92 is disposed above the transfer unit 12, as shown in FIG. 1. Hence, the cleaning unit can easily be accessed for maintenance from the same side of the transfer unit 12 as the photosensitive drums 17.

Moreover, the cleaning unit is provided with the belt cleaning roller 24 that contacts the conveying belt 30 at a position forward of the black photosensitive drum 17K for removing waste toner remaining on the conveying belt 30. Therefore, the belt cleaning roller 24 can remove waste toner deposited on the conveying belt 30 before the region in which the waste toner is deposited contacts the black photosensitive drum 17K. Hence, the cleaning unit prevents residual toner on the conveying belt 30 from becoming deposited on the forwardmost black photosensitive drum 17K and entering the black developer cartridge 15K.

As shown in FIG. 2(*a*), the cleaning unit includes the waste toner accommodating section 92 provided on the black developer cartridge 15K, and the first screw 27, lift 53, and second screw 95 for conveying waste toner removed from the conveying belt 30 from the belt cleaning roller 24 to the waste toner accommodating section 92. Further, the first waste toner retaining unit 26 rotates about the axis independently of both the first screw 27 and the waste toner accommodating section 92, and the belt cleaning roller 24 is separated from the conveying belt in accordance with the rotation of the first toner retaining unit 26. Specifically, as illustrated in FIGS. 16 and 17, the black developer cartridge 15K remains fixed in position and in constant contact with the corresponding photosensitive drum 17, while the operations of the translation cam mechanism 110 place the non-black developer cartridges 15 in contact with the respective photosensitive drums 17 or separate the non-black developer cartridges 15 therefrom. Therefore, since the black developer cartridge 15K is never separated from the corresponding photosensitive drum 17, the waste toner accommodating section 92 provided on the black developer cartridge 15K can be fixed in position relative to the conveying belt 30. Further, the first waste toner retaining unit 26 also remains fixed in position. Therefore, the first screw 27 is prevented from moving.

As a result, through a simple construction, the cleaning unit can be accessed for maintenance from the side of the transfer unit 12 on which the photosensitive drums 17 are provided, without requiring a separate mechanism on the black developer cartridge 15K for moving the waste toner accommodating section 92.

(2) In the printer 1 of the preferred embodiment, the black developer cartridge 15K that supplies black toner to the corresponding photosensitive drum 17 is disposed in the forwardmost position, as shown in FIG. 1.

The black developer cartridge 15K always contacts the black photosensitive drum 17K, whether the printer 1 is in the monochrome mode or the color mode. Hence, by providing the waste toner accommodating section 92 on the black developer cartridge 15K, the printer 1 can be switched between the monochrome mode and the color mode by separating the non-black developer cartridges 15 from their corresponding photosensitive drums 17 or placing the non-black developer cartridges 15 in contact with their respective photosensitive drums 17, without having to move the black developer cartridge 15K away from or in contact with its corresponding photosensitive drum 17. As a result, a separate mechanism for placing the waste toner accommodating section 92 in contact with the conveying belt 30 or separating the waste toner accommodating section 92 therefrom is not required.

(3) In the printer 1 according to the preferred embodiment, the photosensitive drums 17 transfer toner images onto a sheet of paper P conveyed on the conveying belt 30, as shown in FIG. 1. Accordingly, the printer 1 can implement a direct tandem system for directly transferring toner images from the photosensitive drums 17 to the sheet of paper P.

(4) In the printer 1 according to the preferred embodiment, the belt cleaning roller 24 moves between a contact position in which the belt cleaning roller 24 is in contact with the conveying belt 30, and a separated position in which the belt cleaning roller 24 is separated from the conveying belt 30, as illustrated in FIGS. 1 and 13.

In this way, the belt cleaning roller 24 can be separated from the conveying belt 30 when transferring toner images onto sheets of paper P and can be placed in contact with the conveying belt 30 in order to clean the conveying belt 30.

(5) With the printer 1 according to the preferred embodiment, the conveying member is configured of the first screw 27 for conveying waste toner that has been removed by the belt cleaning roller 24 leftward, the lift 53 for conveying the waste toner received from the first screw 27 upward, and the cleaner-side coupling part 63 for relaying the waste toner between the first screw 27 and lift 53, as shown in FIGS. 2(*a*) and 3.

The belt cleaning roller 24 is pivoted about the axis of the cleaner-side coupling part 63 to move between the contact position in which the belt cleaning roller 24 contacts the conveying belt 30 and the separated position in which the belt cleaning roller 24 is separated from the conveying belt 30. Hence, during an image-forming operation, only the belt cleaning roller 24 is pivoted about the axis of the cleaner-side coupling part 63 to be separated from the conveying belt 30, while the waste toner accommodating section 92 and the conveying member remain fixed in position.

During an operation for cleaning the transfer unit 12, only the belt cleaning roller 24 is pivoted about the axis of the cleaner-side coupling part 63 to be placed in contact with the conveying belt 30. As a result, the belt cleaning roller 24 can contact or separate from the conveying belt 30 through a simple construction.

(6) In the printer 1 according to the preferred embodiment, the belt cleaning roller 24 pivots between the contact position and the separated position about the axis of the first screw 27, which the first screw 27 shares with the cleaner-side coupling part 63, as shown in FIG. 1. Hence, the axis of the first screw 27 also serves as the pivoting point of the belt cleaning roller 24. As a result, the belt cleaning roller 24 can be pivoted relative to the transfer unit 12 through an even simpler construction.

(7) In the printer 1 according to the preferred embodiment, the conveying member includes the first sealing member 70 and second sealing member 77 for sealing gaps between the cleaner-side coupling part 63 and lift 53, as illustrated in the enlarged view of FIG. 3. This construction prevents waste toner from leaking between the cleaner-side coupling part 63 and lift 53 when the belt cleaner 16 is pivoted.

(8) In the printer 1 according to the preferred embodiment, the first screw 27 and lift 53 are fixed in position relative to the process frame 14, as illustrated in FIGS. 2(*a*) and 3. Hence, the first screw 27 and lift 53 can be treated as being integrally provided on the process frame 14.

(9) In the printer 1 according to the preferred embodiment, the lift 53 includes a plurality of second waste toner retaining parts 71 for collecting waste toner as the toner is conveyed, and a plurality of blade members 72 for conveying the waste toner collected in the second waste toner retaining parts 71 upward, as illustrated in FIGS. 2(*a*) and 3. Accordingly, the waste toner is temporarily collected in each of the second waste toner retaining parts 71, and the blade members 72 subsequently convey the waste toner upward to successively higher second waste toner retaining parts 71. In other words, the waste toner is conveyed sequentially upward, while temporarily being stored in each of the second waste toner retaining parts 71. As a result, the printer 1 can convey waste toner reliably to each of the second waste toner retaining parts 71.

(10) As shown in FIGS. 2(*a*) and 3, the second waste toner retaining parts 71 in the printer 1 according to the preferred embodiment are formed in hollow cylindrical shapes extending in the left-to-right direction. The second waste toner retaining parts 71 are arranged in a pattern that zigzags upward. The blade members 72 are rotatably disposed in corresponding second waste toner retaining parts 71 and share a central axis with the second waste toner retaining parts 71. Hence, the rotating blade members 72 convey waste toner sequentially upward along a zigzag path. As a result, the blade members 72 can convey waste toner more reliably to each second waste toner retaining part 71.

(11) In the printer 1 according to the preferred embodiment, the conveying member includes the second screw 95 for conveying waste toner that reaches the waste toner accommodating section 92 rightward, as shown in FIG. 5. Accordingly, waste toner conveyed to the waste toner accommodating section 92 can be collected uniformly therein with respect to the left-to-right direction (longitudinal direction).

(12) In the printer 1 according to the preferred embodiment, the conveying member includes the accommodating-section-side relay part 93 for relaying waste toner from the lift 53 to the second screw 95, the shutter part 100 that moves between an open position allowing communication between the accommodating-section-side relay part 93 and lift 53 and a closed position blocking communication between the accommodating-section-side relay part 93 and lift 53, and the grip part 101 that can be operated to open and close the shutter part 100, as shown in FIGS. 8 and 9.

Hence, during an image-forming operation, waste toner can be conveyed from the lift 53 to the accommodating-section-side relay part 93 by operating the grip part 101 to move the shutter part 100 into the open position. When performing maintenance on the cleaning unit, the grip part 101 can be operated to move the shutter part 100 into the closed position, thereby blocking the conveyance of waste toner from the lift 53 to the accommodating-section-side relay part 93 and preventing waste toner from leaking between the lift 53 and accommodating-section-side relay part 93.

(13) In the printer 1 according to the preferred embodiment, the cleaning unit accommodates the belt cleaning roller 24 and first screw 27 and includes the casing 23 for temporarily storing waste toner removed by the belt cleaning roller 24, as shown in FIG. 1. Hence, when the belt cleaning roller 24 removes waste toner from the conveying belt 30, the cleaning unit can temporarily store this waste toner in the casing 23. In this way, the cleaning unit can prevent waste toner removed from the conveying belt 30 from being re-deposited on the conveying belt 30.

(14) In the printer 1 according to the preferred embodiment, the casing 23 pivots together with the belt cleaning roller 24, as illustrated in FIGS. 1 and 13. Hence, the casing 23 can retain waste toner removed by the belt cleaning roller 24 when the belt cleaning roller 24 is pivoted.

(15) In the printer 1 according to the preferred embodiment, the process frame 14 is disposed in the main casing 2 so as to be capable of sliding in the front-to-rear direction, as illustrated in FIGS. 10 and 11. Consequently, the photosensitive drums 17, developer cartridges 15, and the cleaning unit retained in the process frame 14 all slide integrally with the process frame 14. This construction allows easy maintenance of the photosensitive drums 17 and developer cartridges 15, as well as the cleaning unit.

(16) As shown in FIGS. 14 and 16, the process frame 14 in the printer 1 according to the preferred embodiment includes the guide holes 78 for guiding the pivoting motion of the belt cleaning roller 24, and the eccentric cams 80 and first relay gears 81 for placing the belt cleaning roller 24 in contact with and separating the belt cleaning roller 24 from the conveying belt 30. The main casing 2 also includes the second drive gear 116 and second relay gears 117 for transmitting a drive force to the eccentric cams 80 via the first relay gears 81.

When a drive force is transmitted to the eccentric cams 80 via the second drive gear 116, second relay gears 117, and first relay gears 81 for rotating the eccentric cams 80 clockwise in a left side view in order to push the belt cleaning roller 24 upward, the eccentric cams 80 rotate into the pressing position for pressing against the belt cleaning roller 24. In response, the belt cleaning roller 24 is pivoted upward while being guided in the guide holes 78, and separates from the conveying belt 30.

Further, when a drive force is transmitted to the eccentric cams 80 via the second drive gear 116, second relay gears 117, and first relay gears 81 for rotating the eccentric cams 80 counterclockwise in a left side view in order to release the pressure against the belt cleaning roller 24, the eccentric cams 80 rotate into the release position for releasing the pressure against the belt cleaning roller 24. Consequently, the belt cleaning roller 24 pivots downward while guided in the guide holes 78, and again contacts the conveying belt 30. As a result of the movement of the eccentric cams 80, it is possible to place only the belt cleaning roller 24 in contact with the conveying belt 30 and separate only the belt cleaning roller 24 from the conveying belt 30 with ease.

(17) In the printer 1 according to the preferred embodiment, the drum-cleaning rollers 19 are disposed so as to contact the respective photosensitive drums 17 during an image-forming operation, as shown in FIG. 1. At this time, the drum-cleaning rollers 19 temporarily collect residual toner from the photosensitive drums 17. During the waste toner recovery operation, shown in FIG. 13, the drum-cleaning rollers 19 release the toner back onto the respective photosensitive drums 17, and the photosensitive drums 17 discharge the toner onto the conveying belt 30. In this way, the printer 1 can implement waste toner recovery by using a "cleaner-less mechanism" and can be made more compact.

In a cleaner-less mechanism that temporarily retains toner and subsequently discharges the toner back on the conveying belt 30 while the developer cartridges 15 are in contact with the respective photosensitive drums 17, the toner discharged from a forward photosensitive drum 17 onto the conveying belt 30 may become deposited on photosensitive drums 17 positioned to the rear thereof, contaminating the corresponding rearward developer cartridges 15 through these photosensitive drums 17.

However, the cleaning unit of the printer 1 according to the preferred embodiment described above includes a belt cleaning roller 24 that contacts the conveying belt 30 on the front side of the forwardmost black photosensitive drum 17K for removing toner discharged on the conveying belt 30. Hence, this cleaning unit prevents toner discharged on the conveying belt 30 from becoming redeposited on the forwardmost black photosensitive drum 17K and thereby prevents the toner from contaminating the black developer cartridge 15K that is fixed in contact with the black photosensitive drum 17K.

Further, during a waste toner recovery operation, the non-black developer cartridges 15 in the printer 1 according to the preferred embodiment are separated from their respective photosensitive drums 17. Hence, this construction can prevent toner discharged from a forward photosensitive drum 17 onto the conveying belt 30 from contaminating a rearward developer cartridge 15 via a rearward photosensitive drum 17.

6. Variations of the Embodiment

While the invention has been described in detail with reference to the embodiments thereof, it would be apparent to those skilled in the art that various changes and modifications may be made therein without departing from the spirit of the invention.

In the preferred embodiment described above, the left end of the first screw 27 is disposed inside the bottommost second waste toner retaining part 71 and doubles as the blade shaft 74 in the bottommost second waste toner retaining part 71. Further, the belt cleaning roller 24 is separated from the conveying belt in accordance with the rotation of the first toner retaining unit 26.

However, a separate blade shaft 74 may be disposed in the bottommost second waste toner retaining part 71, and the cleaner-side coupling part 63 may be provided so as not to share an axis with the first screw 27.

The printer 1 according to the preferred embodiment described above includes the conveying belt 30 configured of an endless belt. As the conveying belt 30 conveys a sheet of paper P, the printer 1 forms an image on the sheet according to a direct tandem method in which toner images are directly transferred onto the sheet from the photosensitive drums 17.

However, the printer 1 may be provided with a transfer belt configured of an endless belt for transferring toner images instead of the conveying belt 30. With this construction, the printer 1 includes a separate conveying means well known in the art for conveying sheets of paper P and forms images on the sheets according to an intermediate transfer method in which toner images are temporarily transferred onto the transfer belt from the photosensitive drums 17 and subsequently transferred altogether to the sheet. The same operations and effects described in the preferred embodiment can be obtained when using the intermediate transfer method.

The printer 1 according to the preferred embodiment described above is provided with the eccentric cams 80 and a drive transmission member for placing the belt cleaning roller 24 in contact with the conveying belt 30 and separating the belt cleaning roller 24 therefrom. However, the eccentric cams 80 and the drive transmission mechanism may be eliminated when using the intermediate transfer method described above, so that the belt cleaning roller 24 is in constant contact with the transfer belt. The same operations and effects described in the preferred embodiment can be obtained in this case, while simplifying the mechanical structure around the process unit 11.

What is claimed is:

1. An image forming apparatus comprising:

a casing;

a plurality of photosensitive drums arranged parallel to each other in the casing, each of the plurality of photosensitive drums having an axis extending in an axial direction;

a plurality of developing units each of which corresponds to each of the plurality of photosensitive drums, each of the plurality of developing units having a first container configured to accommodate toner, the plurality of developing units including a first developing unit and second developing units, a belt disposed in confrontation with the plurality of photosensitive drums;

a collecting member in contact with the belt to collect waste toner remaining on the belt;

a first conveying member configured to convey the waste toner collected by the collecting member along the axial direction;

a second conveying member configured to convey the waste toner conveyed by the first conveying member along an orthogonal direction orthogonal to the axial direction; and a third conveying member configured to convey the waste toner conveyed by the second conveying member along the axial direction, wherein the first developing unit further comprises a second container configured to store the waste toner conveyed by the third conveying member, each of the second developing units does not comprise a second container configured to store the waste toner conveyed by the third conveying member, and the first developing unit is positioned closer to the collecting member than the second developing units, and wherein the second conveying unit is positioned on one end side of the plurality of photosensitive drums in the axial direction, the second conveying member being overlapped with the second container when viewed in the axial direction.

* * * * *